US012228301B2

(12) United States Patent
Lee et al.

(10) Patent No.: US 12,228,301 B2
(45) Date of Patent: Feb. 18, 2025

(54) AIR CONDITIONING SYSTEM, ELECTRONIC DEVICE, AND CONTROL METHOD OF THE SAME

(71) Applicant: Samsung Electronics Co., Ltd., Suwon-si (KR)

(72) Inventors: Jehyeon Lee, Suwon-si (KR); Kwanwoo Song, Suwon-si (KR); Sunggeun Song, Suwon-si (KR); Yonggwon Lee, Suwon-si (KR); Doyoung Joung, Suwon-si (KR); Abhishek Kumar, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 599 days.

(21) Appl. No.: 17/495,688

(22) Filed: Oct. 6, 2021

(65) Prior Publication Data

US 2022/0107108 A1 Apr. 7, 2022

Related U.S. Application Data

(63) Continuation of application No. PCT/KR2021/013076, filed on Sep. 24, 2021.

(30) Foreign Application Priority Data

Oct. 6, 2020 (KR) ..... 10-2020-0128810

(51) Int. Cl.
*F24F 11/46* (2018.01)
*F24F 11/63* (2018.01)

(Continued)

(52) U.S. Cl.
CPC ..... *F24F 11/46* (2018.01); *F24F 11/63* (2018.01); *F24F 11/84* (2018.01);

(Continued)

(58) Field of Classification Search
CPC .. F24F 11/46; F24F 11/63; F24F 11/80; F24F 11/84; F24F 2110/10; F24F 2140/20; F24F 2140/50; F24F 2140/60; F24F 5/0003

See application file for complete search history.

(56) References Cited

U.S. PATENT DOCUMENTS 4,474,027 A 10/1984 Azmi et al.
5,275,010 A 1/1994 Hisajima et al.

(Continued)

FOREIGN PATENT DOCUMENTS

JP 5856520 * 2/2016 ..... F24F 11/02
JP 2019-214987 A 12/2019

(Continued)

OTHER PUBLICATIONS

International Search Report of the International Searching Authority dated Jan. 14, 2022, in connection with International Application No. PCT/KR2021/013076, 3 pages.

*Primary Examiner* — Tameem D Siddiquee

(57) ABSTRACT

Provided are an electronic device and an air conditioning system capable of reducing an amount of power consumption while maintaining cooling capacity of the air conditioning system, by adaptively adjusting cold water temperature and coolant temperature in consideration of a change of a load. The electronic device according to an embodiment includes: a communicator configured to communicate with an air conditioner including a coil through which cold water flows and a valve for adjusting an amount of the cold water, a chiller unit, and a cooling tower; and a controller configured to determine a target open value of the valve based on a change amount of an air-conditioning load of the air conditioner, and control a temperature of the cold water supplied from the chiller unit to the air conditioner such that an open value of the valve adjust towards the target open value.

14 Claims, 13 Drawing Sheets

(51) Int. Cl.

| | |
|---|---|
| ***F24F 11/84*** | (2018.01) |
| *F24F 110/10* | (2018.01) |
| *F24F 140/20* | (2018.01) |
| *F24F 140/50* | (2018.01) |
| *F24F 140/60* | (2018.01) |

(52) U.S. Cl.
CPC ..... *F24F 2110/10* (2018.01); *F24F 2140/20* (2018.01); *F24F 2140/50* (2018.01); *F24F 2140/60* (2018.01)

(56) References Cited

U.S. PATENT DOCUMENTS

| | | | | |
|---|---|---|---|---|
| 2015/0144323 | A1* | 5/2015 | Cho | G05D 23/1931 165/287 |
| 2016/0054034 | A1 | 2/2016 | Park et al. | |
| 2016/0313751 | A1 | 10/2016 | Risbeck et al. | |
| 2016/0370026 | A1* | 12/2016 | Denton | F24F 11/38 |
| 2017/0208708 | A1* | 7/2017 | Davidson | F25D 23/061 |
| 2018/0160571 | A1* | 6/2018 | Baker | H02S 40/42 |
| 2019/0383206 | A1 | 12/2019 | Uto et al. | |
| 2021/0132640 | A1* | 5/2021 | Conry | F24F 3/065 |

FOREIGN PATENT DOCUMENTS

| | | | |
|---|---|---|---|
| KR | 10-1987-0000986 | B1 | 5/1987 |
| KR | 10-2013-0122430 | A | 11/2013 |
| KR | 10-2016-0006046 | A | 1/2016 |
| KR | 10-2016-0023442 | A | 3/2016 |
| KR | 10-2018-0138463 | A | 12/2018 |
| KR | 10-2103006 | B1 | 5/2020 |
| WO | 2016/006872 | A1 | 1/2016 |

* cited by examiner

FIG. 4

| ROOM TEMPERATURE | OPEN VALUE OF VALVE |
|---|---|
| LOWER THAN TARGET TEMPERATURE | ADJUST TO REDUCTION |
| HIGHER THAN TARGET TEMPERATURE | ADJUST TO INCREASE |

AIR CONDITIONING SYSTEM, ELECTRONIC DEVICE, AND CONTROL METHOD OF THE SAME

CROSS-REFERENCE TO RELATED APPLICATION

This application is a continuation of International Patent Application No. PCT/KR2021/013076 filed on Sep. 24, 2021, which claims priority to Korean Patent Application No. 10-2020-0128810 filed on Oct. 6, 2020, the disclosures of which are herein incorporated by reference in their entirety.

BACKGROUND

1. Field

The present disclosure relates to an air conditioning system for conditioning indoor air and an electronic device for controlling the air conditioning system.

2. Description of Related Art

Generally, a water-cooled air conditioning system means a system that supplies cold water to an air conditioner. The water-cooled air conditioning system cools cold water through heat-exchange between a refrigerant circulating through a refrigerant cycle and cold water circulating through an air conditioner. Water-cooled air conditioning systems which are relatively large-capacity equipment are installed in large buildings, factories, etc.

The water-cooled air conditioning system includes a chiller unit for cooling cold water and a cooling tower for supplying cold water to the chiller unit. The chiller unit supplies cold water that is used by loads in a building, changes the temperature of cold water used by the loads and then collected to preset temperature, and then again supplies the cold water to the loads. Also, the cooling tower supplies a coolant to the chiller unit to provide heat required for the chiller unit to perform heat exchange.

Typically, a constant temperature control method has been used to set cold water temperature and coolant temperature to values calculated for peak load. However, there was a problem that supplying cold water and a coolant of target temperature without considering the states of loads results in a waste of energy.

The present disclosure is directed to providing an electronic device and an air conditioning system capable of reducing an amount of power consumption while maintaining cooling capacity of the air conditioning system, by adaptively adjusting cold water temperature and coolant temperature in consideration of a change of a load.

SUMMARY

An electronic device according to an embodiment includes: a communicator configured to communicate with an air conditioner including a coil through which cold water flows and a valve for adjusting an amount of the cold water, a chiller unit, and a cooling tower; and a controller configured to determine a target open value of the valve based on a change amount of an air-conditioning load of the air conditioner, and control temperature of the cold water supplied from the chiller unit to the air conditioner such that an open value of the valve adjust towards the target open value.

The air conditioner may increase the open value of the valve when a room temperature exceeds a target temperature and reduce the open value of the valve when the target temperature exceeds the room temperature is, and the controller may reduce the target open value when the change amount of the air-conditioning load increases, and increase the target open value when the change amount of the air-conditioning load decreases.

The controller may control the temperature of the cold water to reduce a difference between the open value of the valve and the target open value.

The controller may perform a feedback control on the temperature of the cold water to determine a target temperature of the cold water to maintain the target temperature of the cold water within a preset temperature range from a previous target temperature of the cold water.

The controller may determine the target temperature of the cold water to be within a reference temperature range of the cold water.

The controller may determine an air conditioner of which an open value of a respective valve is greatest from among a plurality of air conditioners, and control the temperature of the cold water such that the open value of the respective valve of the determined air conditioner adjust towards the target open value.

The controller may determine a temperature of a coolant to minimize an amount of power consumption based on an output from a neural network that has been trained for an amount of power consumption according to an outside wet-bulb temperature, a room wet-bulb temperature, a temperature of the coolant supplied from the cooling tower to the chiller unit, and the temperature of the cold water.

The controller may determine a target temperature range of the coolant based on the wet-bulb temperature, and determine the temperature of the coolant based on an output from the neural network with respect to the determined target temperature range.

The controller may determine a temperature range that is greater than a difference between current target temperature and room wet-bulb temperature to be the target temperature range of the coolant.

The controller may determine driving data in which a difference between the room temperature and target temperature is smaller than or equal to a preset range, and determine a coolant temperature range of the determined driving data to be the target temperature range of the coolant.

A method of controlling an electronic device, according to an embodiment, the electronic device including a communicator communicating with an air conditioner including a coil through which cold water flows and a valve for adjusting an amount of the cold water, a chiller unit, and a cooling tower, includes: determining a target open value of the valve based on a change amount of an air-conditioning load of the air conditioner; and controlling a temperature of the cold water supplied from the chiller unit to the air conditioner such that an open value of the valve adjust towards the target open value.

The air conditioner may increase the open value of the valve when a room temperature exceeds a target temperature and reduce the open value of the valve when the target temperature exceeds the room temperature, and the determining of the target open value of the valve based on the change amount of the air-conditioning load of the air conditioner may include: reducing the target open value when the change amount of the air-conditioning load increases; and increasing the target open value when the change amount of the air-conditioning load decreases.

The controlling of the temperature of the cold water such that the open value of the valve adjust towards the target open value may include controlling the temperature of the cold water to reduce a difference between the open value of the valve and the target open value.

The controlling of the temperature of the cold water such that the open value of the valve adjust towards the target open value may include performing a feedback control on the temperature of the cold water to determine target temperature of the cold water to maintain the target temperature of the cold water to be within a preset temperature range from a previous target temperature of the cold water.

The controlling of the temperature of the cold water such that the open value of the valve adjust towards the target open value may include determining the target temperature of the cold water to be within a reference temperature range of the cold water.

The method may further include determining a temperature of a coolant to minimize an amount of power consumption based on an output from a neural network that has been trained for an amount of power consumption according to an outside wet-bulb temperature, a room wet-bulb temperature, the temperature of the coolant that is supplied from the cooling tower to the chiller unit, and the temperature of the cold water.

The determining of the target temperature of the coolant may include determining a target temperature range of the coolant based on the outside wet-bulb temperature, and determine the temperature of the coolant based on an output from the neural network with respect to the determined target temperature range.

The determining of the temperature of the coolant may include determining a temperature range that is greater than a difference between current target temperature and room wet-bulb temperature to be the target temperature range of the coolant.

The determining of the temperature of the coolant may include determining driving data in which a difference between room temperature and target temperature is smaller than or equal to a preset range, and determining a coolant temperature range indicated by the determined driving data to be the target temperature range of the coolant.

An air conditioning system according to an embodiment includes: a cooling tower configured to cool a coolant; a chiller unit configured to receive the coolant from the cooling tower and supply cold water heat-exchanged with the coolant; an air conditioner including a coil through which the cold water flows and a valve for adjusting an amount of the cold water and configured to control an open value of the valve based on a difference between room temperature and target temperature and discharge air passed through the coil and heat-exchanged with the cold water to indoor; and an electronic device configured to determine a target open value of the valve based on a change amount of an air-conditioning load of the air conditioner and control a temperature of the cold water such that the open value of the valve adjust towards the target open value.

An air conditioning system and an electronic device according to an embodiment may reduce an amount of power consumption while maintaining cooling capacity of the air conditioning system, by adaptively adjusting cold water temperature and coolant temperature in consideration of a change of a load.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts:

FIG. 4 is a view for describing a case of controlling a cold water valve of an air conditioner based on a difference between room temperature and target temperature in an air conditioning system according to an embodiment.

DETAILED DESCRIPTION

Figure 1:
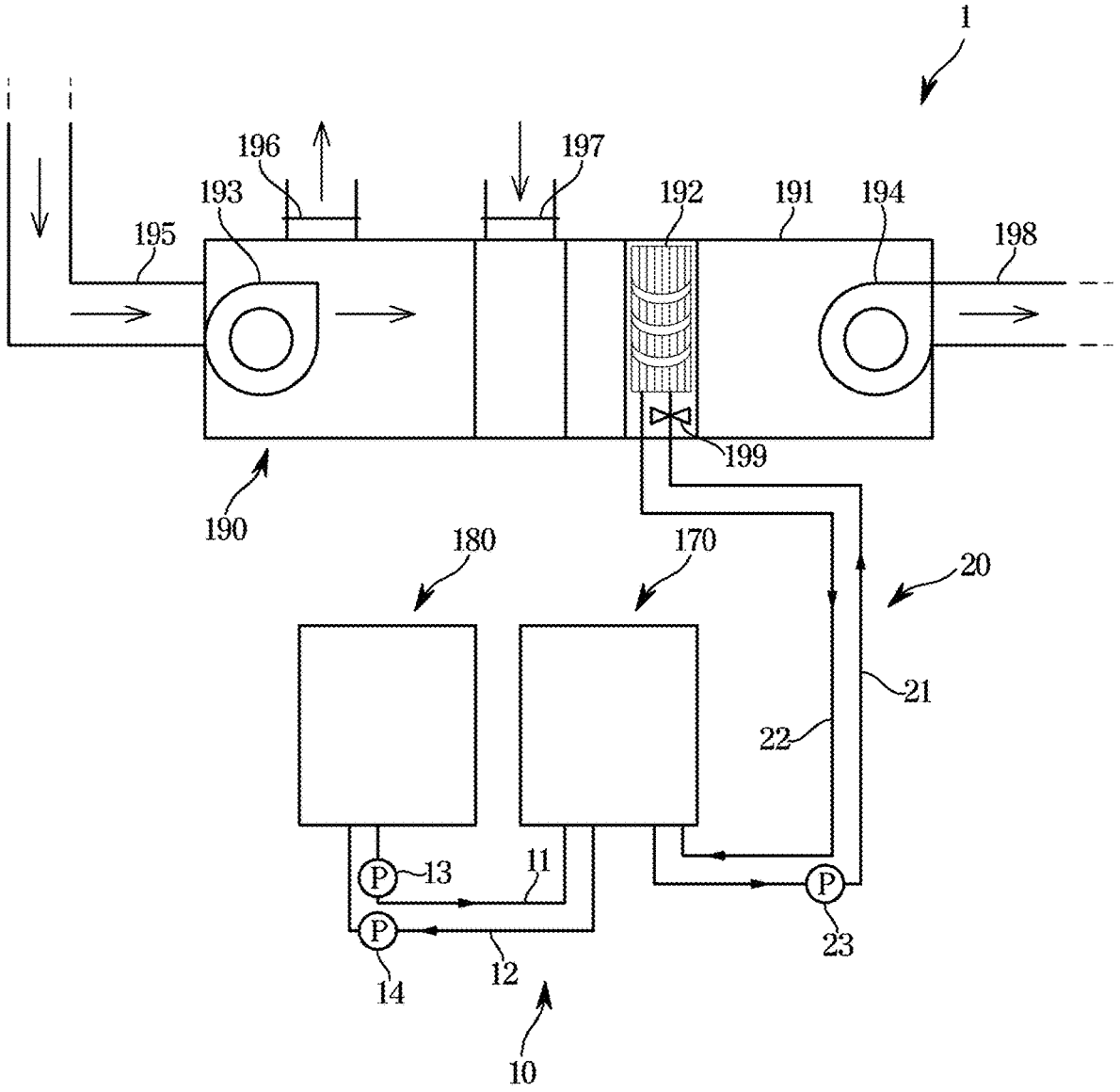
FIG. 1 is a structure diagram showing a structure of an air conditioning system according to an embodiment.

FIGS. 1 through 13, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

In the entire specification, it will be understood that when a certain part is referred to as being "connected" to another part, it can be directly or indirectly connected to the other part. When a part is indirectly connected to another part, it may be connected to the other part through a wireless communication network.

The terms used in the present specification are merely used to describe embodiments, and are not intended to limit and/or restrict the disclosure. An expression used in the singular encompasses the expression of the plural, unless it has a clearly different meaning in the context. In the present specification, it is to be understood that the terms such as "including" or "having", etc., are intended to indicate the existence of the features, numbers, steps, operations, components, parts, or combinations thereof disclosed in the specification, and are not intended to preclude the possibility that one or more other features, numbers, steps, operations, components, parts, or combinations thereof may exist or may be added.

It will be understood that, although the terms "first", "second", etc., may be used herein to describe various components, these components should not be limited by these terms. The above terms are used only to distinguish one component from another. For example, a first component discussed below could be termed a second component, and similarly, a second component may be termed a first component without departing from the scope of rights of this disclosure.

In addition, the terms "portion", "device", "block", "member", and "module" used herein refer to a unit for processing at least one function or operation. For example, the terms may mean at least one process that may be processed by at least one hardware such as field-programmable gate array (FPGA) or application specific integrated circuit (ASIC), or at least one software or processor stored in a memory.

Reference numerals used in operations are provided to identify the operations, without describing the order of the operations, and the operations can be executed in a different order from the stated order unless a specific order is definitely specified in the context.

Hereinafter, embodiments of the disclosure will be described in detail with reference to the accompanying drawings.

Figure 2:
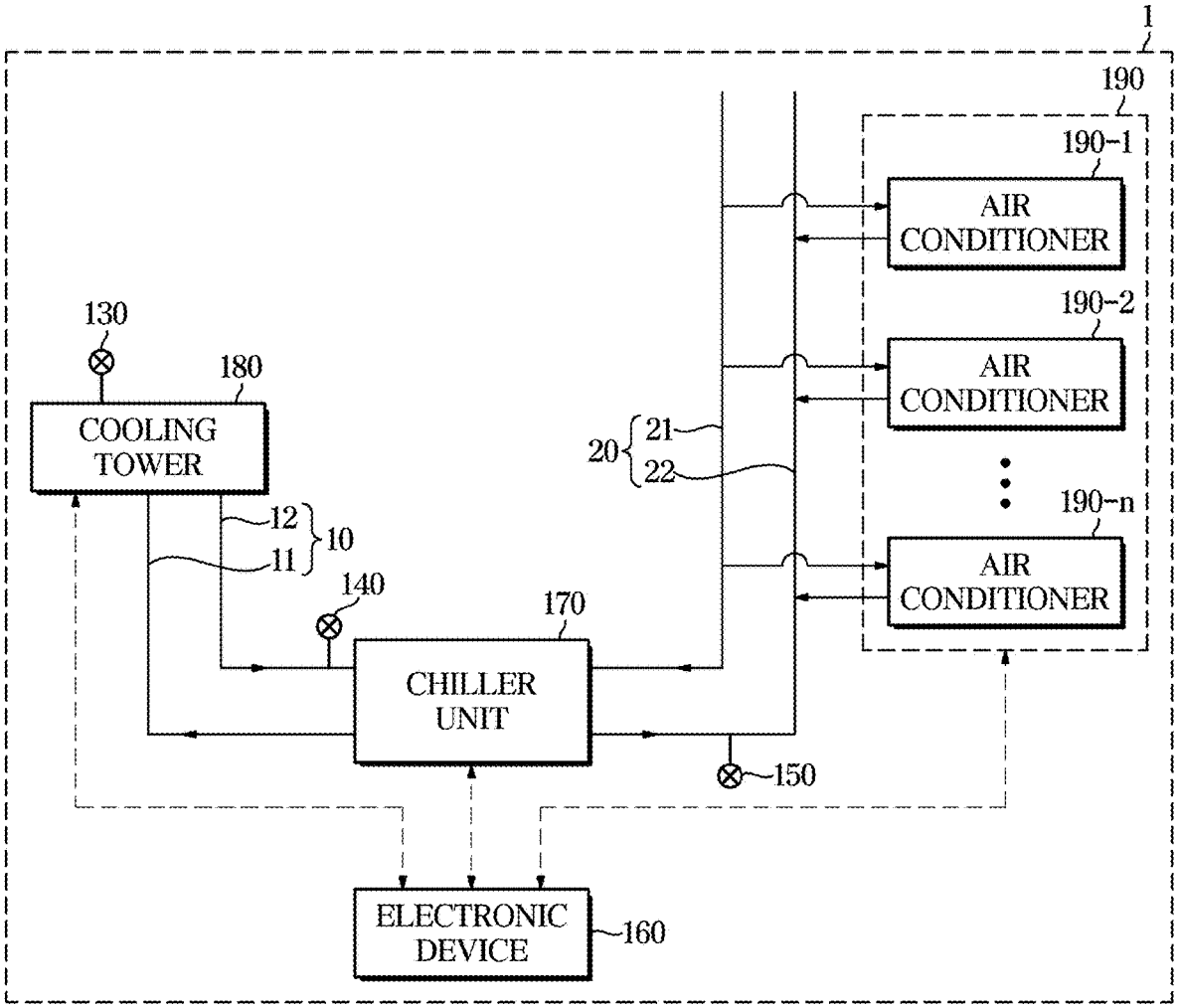
FIG. 2 is a configuration diagram showing a configuration of an air conditioning system according to an embodiment.

FIG. 1 is a structure diagram showing a structure of an air conditioning system according to an embodiment, and FIG. 2 is a configuration diagram showing a configuration of an air conditioning system according to an embodiment.

Referring to FIGS. 1 and 2, an air conditioning system 1 according to an embodiment may be equipment for conditioning air of a large-scale indoor space, such as a building, a factory, etc., and may include a chiller unit 170 forming a cooling cycle, a cooling tower 180 for supplying a coolant to the chiller unit 170, and an air conditioner 190 for heat-exchanging cold water supplied from the chiller unit 170 with air to condition the air of the indoor space.

The chiller unit 170 may circulate a refrigerant by using a coolant supplied from the cooling tower 180. Thereby, the chiller unit 170 may cool cold water to be supplied to the air conditioner 190, and supply the cold water to the air conditioner 190 to induce heat exchange with air.

The chiller unit 170 may include a compressor, a condenser, an expander, and an evaporator, through which a refrigerant circulates. The condenser may be connected to the cooling tower 180 and a coolant circulating path 10 such that the coolant supplied from the cooling tower 180 condenses the refrigerant. The evaporator may be connected to the air conditioner 190 through a cold water circulating path 20 such that the cold water supplied from the air conditioner 190 evaporates the refrigerant.

The cooling tower 180 may include a cooling fan for causing outside air to flow to the coolant to cool the coolant, and supply the cooled coolant to the chiller unit 170. That is, the cooling tower 180 may cause, in order to circulate and use the coolant, the coolant heated by heat-exchange with the condenser to contact air entered by the cooling fan to vaporize a part of the coolant, thereby lowering temperature of the coolant.

For this, the coolant circulating path 10 through which the coolant flows may be provided between the chiller unit 170 and the cooling tower 180, and the coolant may circulate between the chiller unit 170 and the cooling tower 180.

The coolant circulating path 10 may include a coolant inlet path 11 for guiding the coolant to enter the condenser of the chiller unit 170, and a coolant outlet flow 12 for guiding the coolant heated in the chiller unit 170 to move to the cooling tower 180.

In the coolant inlet path 11 and the coolant outlet path 12, coolant pumps 13 and 14 may be provided to cause the coolant to flow. However, according to some embodiments, a coolant pump may be provided on any one of the coolant inlet path 11 and the coolant outlet path 12.

The cooling tower 180 may be provided outdoor to cause the heated coolant to contact outside air, and, at one side of the cooling tower 180, an outside temperature sensor 130 for sensing temperature of outside air may be provided. Also, on the coolant inlet path 11, a coolant temperature sensor 140 for sensing temperature of a coolant exiting the cooling tower 180 may be provided.

The outside temperature sensor 130 may sense outside temperature of an indoor space to which the air conditioning system 1 supplies air. That is, the outside temperature sensor 130 may sense temperature of outside air, and may be positioned at one side of the cooling tower 180 provided outdoor. However, a location of the outside temperature sensor 130 is not limited to the above-mentioned example, and the outside temperature sensor 130 may be positioned at the chiller unit 170 or a main body 191 of the air conditioner 190, according to some embodiments.

Also, the outside temperature sensor 130 may be provided as a sensor capable of sensing wet-bulb temperature, according to some embodiments, and provide outside wet-bulb temperature information to the electronic device 160. Accordingly, the electronic device 160 may identify outside temperature and outside humidity based on the outside wet-bulb temperature information.

The coolant temperature sensor 140 may sense temperature of a coolant exiting the cooling tower 180. For this, the coolant temperature sensor 140 may be provided on the coolant inlet path 11 for guiding a coolant exiting the cooling tower 180 to be supplied to the chiller unit 170.

Also, the cold water circulating path 20 may be provided between the chiller unit 170 and the air conditioner 190 so that cold water circulates between the chiller unit 170 and the air conditioner 190. The cold water circulating path 20 may include a cold water outlet path 21 for guiding cold water cooled in the chiller unit 170 to move to the air conditioner 190, and a cold water inlet path 22 for guiding cold water heated by heat exchange with air in the air conditioner 190 to move to the chiller unit 170.

On at least one of the cold water outlet path 21 and the cold water inlet path 22, a cold water pump 23 may be provided to cause the cold water to flow. For example, the cold water pump 23 may be provided, for example, on the cold water outlet path 21, as shown in FIG. 1.

Also, on the cold water outlet path 21, a cold water temperature sensor 150 for sensing temperature of cold water exiting the chiller unit 170 may be provided. The cold water temperature sensor 150 may sense temperature of cold water exiting the chiller unit 170. For this, the cold water temperature sensor 150 may be provided on the cold water outlet path 21 for guiding cold water exiting the chiller unit 170 to be supplied to the air conditioner 190.

The air conditioner 190 may correspond to a water-cooled air conditioner that heat-exchanges air with cold water. For example, the air conditioner 190 may correspond to an air handling unit (AHU) that mixes indoor air with outside air, heat-exchanges the mixed air with cold water, and then discharges the heat-exchanged air to indoor.

The air conditioner 190 may include, as shown in FIG. 1, the main body 191, a cold water coil 192 which is installed inside the main body 191 and through which cold water passes, and blow fans 193 and 194 provided to both sides of the cold water coil 192 to inhale indoor air and outside air to blow the inhaled air to indoor. The blow fans 193 and 194 may include a first blow fan 193 for inhaling indoor air and outside air to the inside of the main body 191 and a second blow fan 194 for discharging conditioned air to the outside of the main body 191.

The main body 191 of the air conditioner 190 may include an indoor air inhaling portion 195, an indoor air discharging portion 196, an outside air inhaling portion 197, and a conditioned air discharging portion 198.

When the blow fans 193 and 194 are driven, a part of air entered through the indoor air inhaling portion 195 may be discharged through the indoor air discharging portion 196, and the remaining part may be mixed with outside air inhaled through the outside air inhaling portion 197 and then pass through the cold water coil 192 to exchange heat. Then, the heat-exchanged, mixed air may be discharged to indoor through the conditioned air discharging portion 198.

That is, a part of indoor air inhaled through the indoor air inhaling portion 195 may be mixed with outside air, exchange heat, and then be again discharged to indoor.

The air conditioner 190 may include a cold water valve 199 for adjusting an amount of cold water flowing through the cold water coil 192. The cold water coil 192 may be connected to the cold water outlet path 21 and the cold water inlet path 22 to exchange cold water with the chiller unit 170. The cold water valve 199 may be provided at a side connected to the cold water outlet path 21 on flow paths of the cold water coil 192, and change an open value to adjust an amount of cold water flowing through the cold water coil 192.

Thereby, the air conditioner 190 may adjust an open value of the cold water valve 199 to adjust an amount of cold water flowing through the cold water coil 192. That is, the air conditioner 190 may adjust an open value of the cold water valve 199 to adjust an amount of heat exchange with air. In other words, the air conditioner 190 may increase an open value of the cold water valve 199 to increase an amount of cold water flowing through the cold water coil 192, thereby increasing an amount of heat exchange with air. Also, the air conditioner 190 may reduce an open value of the cold water valve 199 to reduce an amount of cold water flowing through the cold water coil 192, thereby reducing an amount of heat exchange with air.

The air conditioner 190 may adjust an open value of the cold water valve 199 based on a difference between room temperature and target temperature. For example, when room temperature is higher than target temperature, the air conditioner 190 may perform a control of increasing an open value of the cold water valve 199, and, when room temperature is lower than target temperature, the air conditioner 190 may perform a control of reducing an open value of the cold water valve 199.

According to some embodiments, the air conditioning system 1 may include a plurality of air conditioners 190 (190-1, 190-2, . . . , **190-*n*), as shown in FIG. 2, wherein each of the air conditioners 190 may be connected to the cold water outlet path 21 and the cold water inlet path 22 to exchange cold water with the chiller unit 170. Each of the air conditioners 190 may include the cold water valve 199, and adjust the cold water valve 199 to adjust indoor air corresponding to the air conditioner 190**.

Also, the air conditioner 190 may include a room temperature sensor (not shown) for sensing temperature of an indoor space. The room temperature sensor may be provided at one side of the indoor air inhaling portion 195 or the conditioned air discharging portion 198 that communicates with an indoor space. However, a location of the indoor temperature sensor is not limited to the above-mentioned example, and according to some embodiments, the indoor temperature sensor may be provided as a separate module in an indoor space to transfer room temperature to the electronic device 160 through wired or wireless communication.

Also, the indoor temperature sensor may be provided as a sensor capable of sensing wet-bulb temperature, according to some embodiments, and the air conditioner 190 may transfer room wet-bulb temperature information to the electronic device 160. Accordingly, the electronic device 160 may identify room temperature and room humidity based on the room wet-bulb temperature information.

Also, the air conditioning system 1 may include the electronic device 160, as shown in FIG. 2, and the electronic device 160 may control the chiller unit 170, the cooling tower 180, and the air conditioner 190. For example, the electronic device 160 may correspond to a controller capable of controlling a configuration of the air conditioning system 1, such as a building automation system (BAS), a building energy management system (BEMS), etc.

The electronic device 160 may control temperature of cold water discharged from the chiller unit 170 and temperature of a coolant discharged from the cooling tower 180. That is, the electronic device 160 may adaptively adjust cold water temperature and coolant temperature to reduce an amount of power consumption while maintaining cooling capacity.

Generally, as cold water temperature is lower, an amount of power consumption of the chiller unit 170 may increase. The reason is because, as cold water is cooled to lower temperature, consumption power of the heat exchanger of the chiller unit 170, configured with the compressor, the condenser, the expander, and the evaporator, increases. In other words, as temperature of cold water discharged from the chiller unit 170 increases, consumption power of the chiller unit 170 may be lowered. However, an increase of cold water temperature may lower an amount of heat exchange with air in the air conditioner 190, thereby causing an increase of supply air temperature of the air conditioner 190 and increasing an amount of power consumption of the blow fans 193 and 194. Accordingly, room temperature and room humidity may increase.

Accordingly, the electronic device 160 may lower consumption power of the chiller unit 170 by setting cold water temperature to high temperature within a range in which the cold water temperature does not influence room temperature and room humidity. More specifically, the electronic device 160 may determine a target open value of the cold water valve 199 based on a change amount of an air-conditioning load of the air conditioner 190, and control temperature of cold water such that an open value of the cold water valve 199 adjust towards the determined target open value.

In other words, when a change amount of an air-conditioning load is small, the electronic device 160 may increase a target open value of the cold water valve 199 to raise temperature of cold water, and perform a feedback control on cold water temperature based on a difference between an open value of the cold water valve 199 and the target open value.

Also, when a change amount of an air-conditioning load is great, the electronic device 160 may reduce a target open value of the cold water valve 199, and perform a feedback control on cold water temperature based on a difference between an open value of the cold water valve 199 and the target open value. That is, the electronic device 160 may reduce an open value of the cold water valve 199 to ensure a wide control range of cold water temperature.

In this way, the electronic device 160 may adaptively control cold water temperature in correspondence to a change of an air-conditioning load while lowering consumption power of the chiller unit 170, thereby reducing an amount of power consumption of the air conditioning system 1 while maintaining cooling capacity. A control for cold water temperature of the electronic device 160 will be described in detail, later.

Also, to lower temperature of a coolant, consumption power of a cooling fan needs to be raised. Therefore, as temperature of a coolant discharged from the cooling tower 180 is lowered, consumption power of the cooling tower 180 may increase. In other words, as temperature of a coolant increases, consumption power of the cooling tower 180 may be lowered. However, when temperature of a coolant increases, a coefficient of performance of the condenser of the chiller unit 170 using the coolant may be lowered, so that consumption power of the chiller unit 170 may increase. As such, a trade off may occur between the consumption power of the chiller unit 170 and the consumption power of the cooling tower 180.

Accordingly, the electronic device 160 may determine temperature of a coolant such that an amount of power consumption of the air conditioning system 1 is minimized, based on an output from a neural network that has trained an amount of power consumption according to driving data. At this time, the electronic device 160 may limit an optimization search range by determining a realizable coolant target temperature range based on wet-bulb temperature of outside air. That is, the electronic device 160 may determine a realized coolant target temperature range by determining temperature that is greater than a difference between current target temperature and room wet-bulb temperature to be a coolant target temperature range, and determine coolant temperature at which an amount of power consumption of the air conditioning system 1 is minimized based on an output from a neural network with respect to the determined temperature range. Determining coolant temperature will be described in detail, later.

So far, a structure and configuration of the air conditioning system 1 have been described. Hereinafter, controlling cold water temperature and coolant temperature in the air conditioning system 1 will be described in detail.

Figure 3:
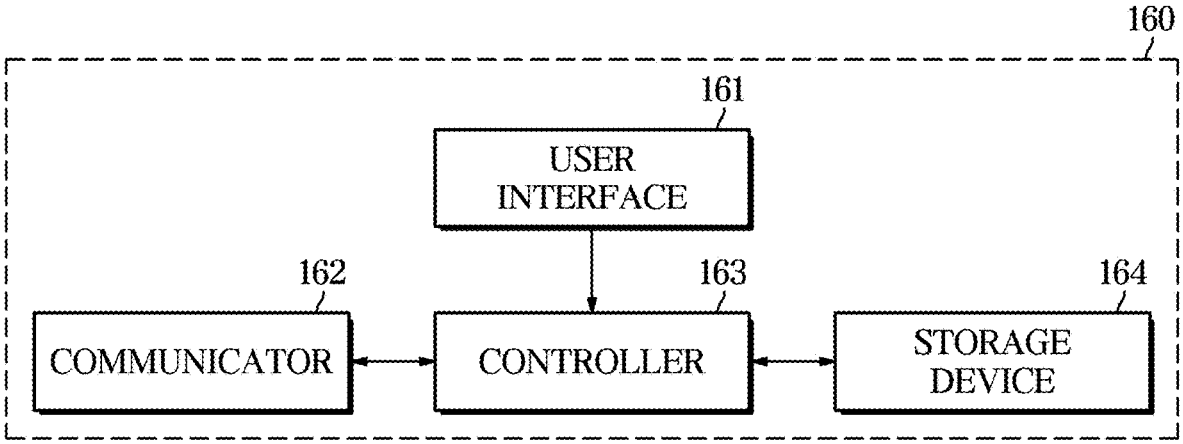
FIG. 3 is a control block diagram of an electronic device according to an embodiment.

FIG. 3 is a control block diagram of the electronic device 160 according to an embodiment.

Referring to FIG. 3, the electronic device 160 according to an embodiment may include a user interface 161 for receiving an input from a user, a communicator 162 for communicating with the chiller unit 170, the cooling tower 180, and the air conditioner 190, a controller 163 for controlling cold water temperature and coolant temperature, and a storage device 164 storing various information required for controls.

At least one component may be added or omitted to correspond to performance of components of the electronic device 160 shown in FIG. 3. Also, it will be easily understood by one of ordinary skill in the art that mutual positions of the components may change to correspond to the performance and structure of the system.

The user interface 161 may receive target temperature for room temperature from a user. The user interface 161 may be connected to the controller 163 through wired or wireless communication to transfer information about target temperature to the controller 163. For this, the user interface 161 may include a known type of input device. Also, the user interface 161 may include a display device for displaying a state of the air conditioning system 1, and the input device may be implemented as a touch panel integrated into the display device.

The communicator 162 may transmit/receive data to/from the chiller unit 170, the cooling tower 180, and the air conditioner 190. More specifically, the communicator 162 may communicate with the chiller unit 170, the cooling tower 180, and the air conditioner 190 through wired or wireless communication. For this, the communicator 162 may be provided as a known type of communication module.

The communicator 161 may receive room temperature (room wet-bulb temperature) information, outside temperature (outside wet-bulb temperature) information, cold water temperature information, and coolant temperature information from the chiller unit 170, the cooling tower 180, and the air conditioner 190. However, according to some embodiments, the communicator 161 may receive room temperature (room wet-bulb temperature) information, outside temperature (outside wet-bulb temperature) information, cold water temperature information, and coolant temperature information from the room temperature sensor, the outside temperature sensor 130, the coolant temperature sensor 140, and the cold water temperature sensor 150, respectively.

Also, the communicator 161 may transmit cold water target temperature information and coolant target temperature information set by the controller 163 to the chiller unit 170 and the cooling tower 180, according to a control of the controller 163.

The controller 163 may control temperature of cold water discharged from the chiller unit 170 and temperature of a coolant discharged from the cooling tower 180. That is, the controller 163 may adaptively adjust cold water temperature and coolant temperature to reduce an amount of power consumption while maintaining cooling capacity.

The controller 163 may lower consumption power of the chiller unit 170 by setting cold water temperature to high temperature within a range in which the cold water temperature does not influence room temperature and room humidity. More specifically, the controller 163 may determine a target open value of the cold water valve 199 based on a change amount of an air-conditioning load of the air conditioner 190, and control cold water target temperature such that an open value of the cold water valve 199 adjust towards the determined target open value.

The controller 163 may determine a change amount of an air-conditioning load of the air conditioner 190 based on a temperature change amount of room temperature per unit time. The air-conditioning load of the air conditioner 190 may change more greatly as a change of room temperature per unit time with respect to target temperature is greater. Accordingly, when room temperature changes greatly due to a use environment of an indoor space, a condition of outside air, air-conditioning equipment replacement, a change of a control method of equipment installed in an indoor space, etc., an air-conditioning load of the air conditioner 190 may also change greatly.

The controller 163 may reduce a target open value of the cold water valve 199 when a change amount of an air-conditioning load increases, and, when a change amount of an air-conditioning decreases, the controller 163 may increase a target open value of the cold water valve 199.

At this time, when room temperature is higher than target temperature, the air conditioner 190 may increase an open value of the cold water valve 199, and, when the room temperature is lower than the target temperature, the air conditioner 190 may reduce an open value of the cold water valve 199.

That is, an open value of the cold water valve 199 may be feedback controlled such that room temperature or supply air temperature reaches target temperature. In other words, an open value of the cold water valve 199 may be feedback controlled according to an air-conditioning load. At this time, the open value of the cold water valve 199 may be feedback controlled according to cold water temperature, to maintain an amount of heat exchange provided from the air conditioner 190. For example, by increasing the open value of the cold water valve 199 together with an increase of cold water temperature to increase an amount of cold water flowing through the cold water coil 192, an amount of heat exchange may be maintained. Also, by reducing the open value of the cold water valve 199 together with a decrease of cold water temperature to reduce an amount of cold water flowing through the cold water coil 192, an amount of heat exchange may be maintained.

Accordingly, the controller 163 may perform a feedback control on cold water temperature such that a difference between an open value of the cold water valve 199 and a determined target open value is reduced, thereby controlling the open value of the cold water valve 199 to follow the target open value. That is, the controller 163 may perform a feedback control (e.g., PI control or PID control) on cold water temperature based on a difference between an actual open value and a target open value.

In other words, when a change amount of an air-conditioning load is small, the controller 163 may increase a target open value of the cold water valve 199 to raise temperature of cold water, and perform a feedback control on cold water temperature based on a difference between an open value of the cold water valve 199 and the target open value. Thereby, the controller 163 may lower consumption power of the chiller unit 170.

Also, when a change amount of an air-conditioning load is great, the controller 163 may reduce a target open value of the cold water valve 199, and perform a feedback control on cold water temperature based on a difference between an open value of the cold water valve 199 and the target open value. That is, the controller 163 may ensure a wide control range of cold water temperature by reducing an open value of the cold water valve 199. As an open value of the cold water valve 199 is reduced, cold water temperature required to provide the same amount of heat exchange may be lowered, and an increasable range of cold water temperature may be widened by the lowered cold water temperature to widen a control range of cold water temperature. Accordingly, when a change amount of an air-conditioning load is great, the controller 163 may adjust a target open value to reduce an open value of the cold water valve 199 and ensure a wide control range of cold water temperature, thereby adaptively controlling cold water temperature to correspond to a change of an air-conditioning load. For example, when an air-conditioning load is reduced greatly, the controller 163 may raise cold water temperature to higher temperature to correspond to the wide control range, thereby greatly reducing consumption power.

Thereby, the controller 163 may adaptively control cold water temperature to correspond to a change of an air-conditioning load while lowering consumption power of the chiller unit 170, thereby reducing an amount of power consumption of the air conditioning system 1 while maintaining cooling capacity.

Also, when the controller 163 determines target temperature of cold water by performing a feedback control on cold water temperature based on a difference between a current open value of the cold water coil 192 and a target open value, the controller 163 may determine the target temperature of the cold water to be within a preset temperature range from previous target temperature.

That is, the controller 163 may determine target temperature determined based on a feedback control to be within a preset temperature range (e.g., ±1° C.) from previous target temperature.

For example, when target temperature that is higher than previous target temperature by preset temperature (e.g., 1° C.) is calculated based on a feedback control, the controller 163 may determine the temperature that is higher than the previous target temperature by the preset temperature to be cold water target temperature. Also, when target temperature that is lower than previous target temperature by preset temperature (e.g., 1° C.) is calculated based on a feedback control, the controller 163 may determine the temperature that is lower than the previous target temperature by the preset temperature to be cold water target temperature.

Also, when the controller 163 determines target temperature of cold water by performing a feedback control on cold water temperature based on a difference between a target open value and a current open value of the cold water coil 192, the controller 163 may determine the target temperature of the cold water to be within a reference temperature range.

That is, the controller 163 may determine target temperature determined based on a feedback control to be within a reference temperature range of cold water supported by the chiller unit 170. Herein, the reference temperature range may correspond to a temperature range between minimum temperature and maximum temperature of cold water which may be discharged from the chiller unit 170.

For example, when target temperature that is higher than the reference temperature range is calculated based on a feedback control, the controller 163 may determine maximum temperature within the reference temperature range to be cold water target temperature. Also, when target temperature that is lower than the reference temperature range is calculated based on a feedback control, the controller 163 may determine minimum temperature within the reference temperature range to be cold water target temperature.

As such, when the controller 163 performs a feedback control on cold water temperature based on a difference between a target open value and a current open value of the cold water coil 192, the controller 163 may limit a setting range of cold water target temperature, thereby preventing error divergence caused by a control error in the feedback control.

According to some embodiments, when the air conditioning system 1 includes the plurality of air conditioners 190 (190-1, 190-2, . . . , **190-*n*), the controller 163 may identify air conditioners operating from among the plurality of air conditioners 190, and determine an air conditioner 190 of which an open value of the cold water coil 192 is greatest among the identified air conditioners. Also, the controller 163 may perform a feedback control on cold water temperature based on the open value of the cold water coil 192 of the determined air conditioner. That is, the controller 163 may determine a target open value according to an air-conditioning load of the determined air conditioner, and control cold water temperature such that the open value of the cold water coil 192** adjust towards the target open value.

Because a great open value of the cold water coil 192 may mean a great air-conditioning load while the same cold water temperature is provided, the electronic device 160 may control cold water temperature based on an air conditioner having a greatest air-conditioning load to provide air conditioning satisfying all of a plurality of indoor spaces corresponding to the plurality of air conditioners 190.

Also, the controller 163 may determine temperature of a coolant based on an output from a neural network that has trained an amount of power consumption according to driving data such that an amount of power consumption of the air conditioning system 1 is minimized. The neural network may be trained according to driving data of the air conditioning system 1, and, when the neural network receives coolant temperature information, the neural network may output an amount of power consumption of the air conditioning system 1. Driving data of the air conditioning system 1 may be data about previous driving, and may include at least one of outside temperature, outside humidity, cold water temperature, coolant temperature, and an amount of power consumption upon driving.

The above-described neural network indicates mechanical learning embodying a neural structure capable of performing deep learning, and improves the reliability of learning by continuing to change weights and biases corresponding to the configuration of the neural network. That is, the neural network may improve results of inference of the neural network by continuing to update weights, biases, and activation functions included in the neural network based on driving data.

The neural network may include a convolution neural network (CNN) that convolves driving data to generate a features map and inputs the features map to a neural network, although not limited thereto. However, another deep learning algorithm including recurrent neural networks (RNN) may be executed. That is, a type of the neural network is not limited.

At this time, the controller 163 may limit an optimization search range by determining a realizable coolant target temperature range based on wet-bulb temperature of outside air. That is, the controller 163 may determine temperature that is greater than a difference between current target temperature and room wet-bulb temperature to be a coolant target temperature range to determine a realizable coolant target temperature range, and determine coolant temperature at which an amount of power consumption of the air conditioning system 1 is minimized, based on an output from the neural network with respect to the determined temperature range. In other words, the controller 163 may input temperature within the coolant target temperature range to the neural network, and obtain coolant temperature having a minimum amount of power consumption within the coolant target temperature range from the neural network.

Also, according to some embodiments, the controller 163 may determine a coolant target temperature range by further considering driving data. More specifically, the controller 163 may determine, as a coolant target temperature range, a coolant temperature range of when a difference between room temperature and target temperature is smaller than or equal to a preset range in temperature that is greater than a difference between current target temperature and room wet-bulb temperature, based on driving data. In other words, the controller 163 may determine a coolant temperature range of when a difference between room temperature and target temperature is smaller than or equal to a preset range in previous driving, based on driving data, and determine, as a coolant target temperature range, a temperature range overlapping with the determined coolant temperature range in temperature that is greater than a difference between current target temperature and room wet-bulb temperature.

Thereby, the electronic device 160 may determine, as the coolant target temperature range, coolant temperature capable of supporting target temperature based on driving data, thereby raising the accuracy of a control to target temperature.

As such, the electronic device 160 may limit an optimization search range by determining a coolant target temperature range by considering wet-bulb temperature of outside air or driving data, thereby raising the accuracy of prediction on an amount of power consumption. Also, by limiting learning data to the coolant target temperature range, prediction accuracy may be improved with relatively small learning data.

At this time, the chiller unit 170 may receive coolant from the cooling tower 180 and supply cold water subject to heat exchange with the coolant to the air conditioner 190. At this time, the chiller unit 170 may control the heat exchanger according to cold water target temperature received from the electronic device 160 to discharge cold water of target temperature. For example, when cold water target temperature is lowered, the chiller unit 170 may increase power that is supplied to at least one of the compressor, the condenser, the expander, or the evaporator.

The cooling tower 180 may again cool coolant heated by the chiller unit 170 and supply the coolant to the chiller unit 170. At this time, the cooling tower 180 may control the cooling fans according to coolant target temperature received from the electronic device 160 to discharge coolant of target temperature. For example, when coolant target temperature is lowered, the cooling tower 180 may increase power that is supplied to the cooling fans.

The air conditioner 190 may include the cold water coil 192 through which cold water flows and the cold water valve 199 for adjusting an amount of cold water flowing through the cold water coil 192, and control an open value of the cold water valve 199 based on a difference between room temperature and target temperature. Also, the air conditioner 190 may discharge air passed through the cold water coil 192 and heat-exchanged with cold water to indoor.

The controller 163 may include at least one memory storing a program for performing the above-described operations and operations that will be described later, and at least one processor for executing the stored program.

The storage device 164 may store various information required for controls. For example, the storage device 164 may store a correlation between open values and cold water temperature, a reference temperature range of cold water, a neural network that has trained an amount of power consumption according to driving data, etc. For this, the storage device 164 may be provided as a known type of storage medium.

So far, the control flow of the electronic device 160 has been described. Hereinafter, controlling cold water temperature in the electronic device 160 will be described in detail.

Figure 5:
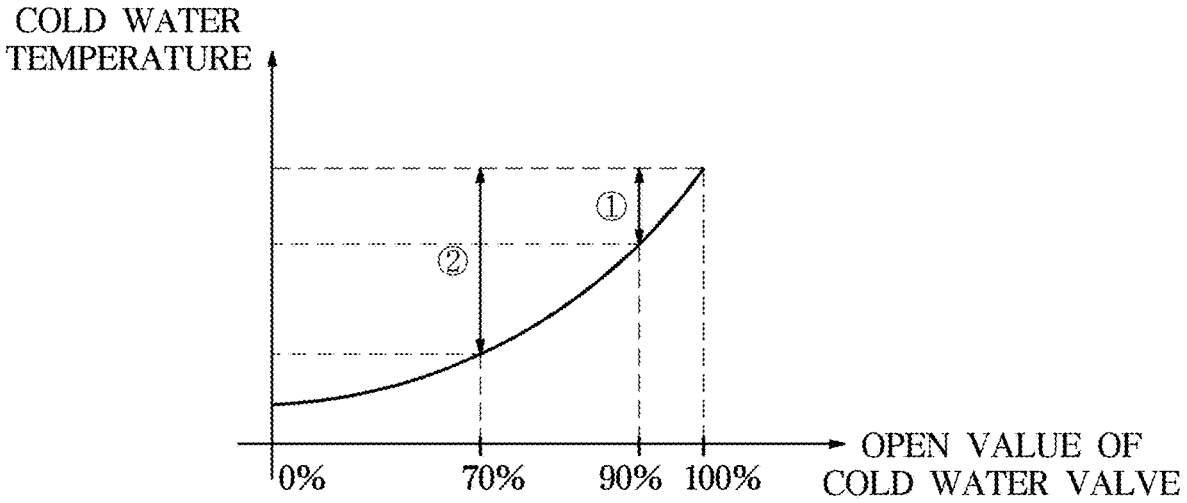
FIG. 5 is a view representing a correlation between cold water temperature and open values of a cold water valve in an air conditioning system according to an embodiment.
Figure 6:
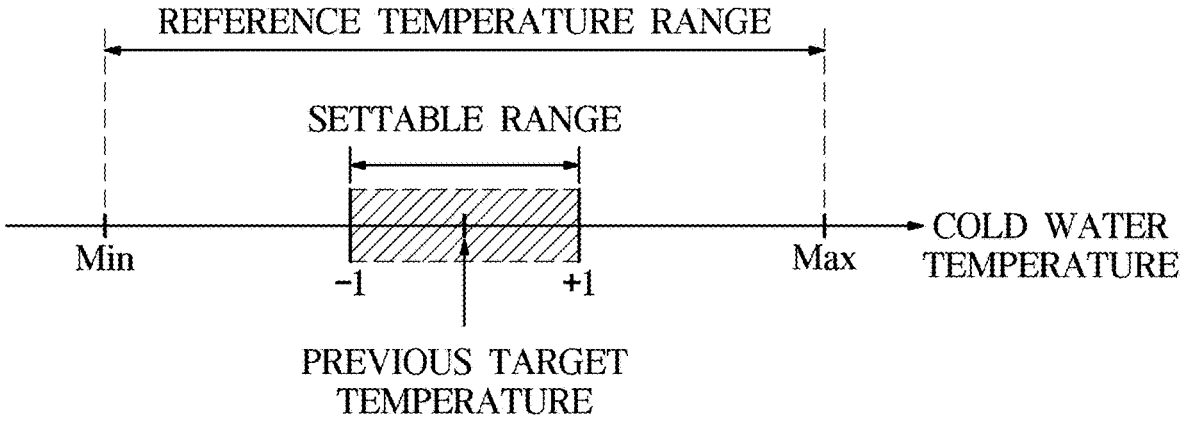
FIG. 6 is a view representing a case of feed-back controlling cold water temperature in an electronic device according to an embodiment.

FIG. 4 is a view for describing a case of controlling the cold water valve 199 of the air conditioner 190 based on a difference between room temperature and target temperature in the air conditioning system 1 according to an embodiment, FIG. 5 is a view representing a correlation between cold water temperature and open values of the cold water valve 199 in the air conditioning system 1 according to an embodiment, and FIG. 6 is a view representing a case of feed-back controlling cold water temperature in the electronic device 160 according to an embodiment.

Referring to FIG. 4, the air conditioner 190 may adjust an amount of cold water flowing through the cold water coil 192 by adjusting an open value of the cold water valve 199. That is, the air conditioner 190 may adjust an amount of heat exchange with air by adjusting an open value of the cold water valve 199. In other words, the air conditioner 190 may increase an open value of the cold water valve 199 to increase an amount of cold water flowing through the cold water coil 192, thereby increasing an amount of heat exchange with air. Also, the air conditioner 190 may reduce an open value of the cold water valve 199 to reduce an amount of cold water flowing through the cold water coil 192, thereby reducing an amount of heat exchange with air.

The air conditioner 190 may adjust an open value of the cold water valve 199 based on a difference between room temperature and target temperature. For example, when room temperature is lower than target temperature, as shown in FIG. 4, the air conditioner 190 may reduce an open value of the cold water valve 199, and, when the room temperature is higher than the target temperature, the air conditioner 190 may increase an open value of the cold water value 199.

That is, an open value of the cold water valve 199 may be feedback controlled such that room temperature or supply air temperature reaches target temperature. In other words, an open value of the cold water valve 199 may be feedback controlled according to an air-conditioning load. At this time, an open value of the cold water valve 199 may be feedback controlled according to cold water temperature to maintain an amount of heat exchange with respect to an air-conditioning load. For example, an open value of the cold water valve 199 may increase together with an increase of cold water temperature to increase an amount of cold water flowing through the cold water coil 192, thereby maintaining an amount of heat exchange. Also, an open value of the cold water valve 199 may be reduced together with a decrease of cold water temperature to reduce an amount of cold water flowing through the cold water coil 192, thereby maintaining an amount of heat exchange.

Referring to FIG. 5, the electronic device 160 may lower consumption power of the chiller unit 170 by setting cold water temperature to high temperature within a range in which the cold water temperature does not influence room temperature and room humidity. More specifically, the electronic device 160 may determine a target open value of the cold water valve 199 based on a change amount of an air-conditioning load of the air conditioner 190, and control target temperature of cold water such that the open value of the cold water valve 199 adjust towards the determined target open value.

The electronic device 160 may determine a change amount of an air-conditioning load of the air conditioner 190 based on a temperature change amount of a room per unit time. The air-conditioning load of the air conditioner 190 may change more greatly as a change of room temperature per unit time with respect to target temperature is greater. Accordingly, when room temperature changes greatly due to a use environment of an indoor space, a condition of outside air, air-conditioning equipment replacement, a change of a control method of equipment installed in an indoor space, etc., an air-conditioning load of the air conditioner 190 may also change greatly.

The controller 163 may reduce a target open value of the cold water valve 199 when a change amount of an air-conditioning load increases, and, when a change amount of an air-conditioning load decreases, the controller 163 may increase a target open value of the cold water valve 199.

The electronic device 160 may perform a feedback control on cold water temperature such that a difference between an open value of the cold water valve 199 and the determined target open value is reduced, thereby controlling the open value of the cold water valve 199 to follow the target open value. That is, the controller 163 may perform a feedback control (e.g., PI control or PID control) on cold water temperature based on a difference between an actual open value and a target open value.

In this case, when a change amount of an air-conditioning load is small, the electronic device 160 may increase a target open value of the cold water valve 199 to raise temperature of cold water, and perform a feedback control on cold water temperature based on a difference between an open value of the cold water valve 199 and the target open value. Thereby, the electronic device 160 may lower consumption power of the chiller unit 170. That is, when an air-conditioning load of the air conditioner 190 is constant, the electronic device 160 may increase a target open value of the cold water valve 199 and reduce cold water target temperature, to lower consumption power of the chiller unit 170 while providing a constant amount of heat exchange with respect to the air-conditioning load.

Also, when a change amount of an air-conditioning load is high, the electronic device 160 may reduce a target open value of the cold water valve 199, and perform a feedback control on cold water temperature based on a difference between an open value of the cold water valve 199 and the target open value.

That is, the electronic device 160 may ensure a wide control range of cold water temperature by reducing an open value of the cold water valve 199. As an open value of the cold water valve 199 is reduced, cold water temperature required to provide the same amount of heat exchange may be lowered, and an increasable range of cold water temperature may be widened by the lowered cold water temperature to widen a control range of cold water temperature.

For example, as shown in FIG. 5, cold water temperature of when an open value of the cold water valve 199 is 70% may be lower than cold water temperature of when an open value of the cold water valve 199 is 90%. Accordingly, an increasable temperature range ② of cold water temperature of when an open value of the cold water valve 199 is 70% may be wider than an increasable temperature range ① of cold water temperature of when an open value of the cold water valve 199 is 90%. As a result, a cold water temperature control range of when an open value of the cold water valve 199 is 70% may be wider than a cold water temperature control range of when an open value of the cold water valve 199 is 90%.

Accordingly, when a change amount of an air-conditioning load is great, the electronic device 160 may adjust a target open value to reduce an open value of the cold water valve 199 to ensure a wide control range of cold water temperature, thereby adaptively controlling cold water temperature to correspond to the change of the air-conditioning load. For example, when an air-conditioning load is reduced greatly, the electronic device 160 may raise cold water temperature to higher temperature to correspond to a wide control range, thereby greatly reducing power consumption.

Thereby, the electronic device 160 may lower consumption power of the chiller unit 170 while adaptively controlling cold water temperature to correspond to a change of an air-conditioning load, thereby reducing an amount of power consumption of the air conditioning system 1 while maintaining cooling capacity.

Also, when the electronic device 160 determines target temperature of cold water by performing a feedback control on cold water temperature based on a difference between a current open value of the cold water coil 192 and a target open value, the electronic device 160 may determine the target temperature of the cold water to be within a preset temperature range from previous target temperature.

That is, the electronic device 160 may determine target temperature determined based on a feedback control to be within a preset temperature range (e.g., ±1° C.) from previous target temperature. In other words, the electronic device 160 may determine, as shown in FIG. 6, a preset temperature range (e.g., ±1° C.) from previous target temperature to be a settable range, and determine cold water target temperature within the settable range.

For example, when target temperature within the preset temperature range from previous target temperature is calculated based on a feedback control, the electronic device 160 may determine the calculated target temperature to be cold water target temperature. Also, when target temperature that is higher than previous target temperature by preset temperature (e.g., 1° C.) is calculated based on a feedback control, the controller 163 may determine the temperature that is higher than the previous target temperature by the preset temperature to be cold water target temperature. Also, when target temperature that is lower than previous target temperature by the preset temperature (e.g., 1° C.) is calculated based on a feedback control, the controller 163 may determine the temperature that is lower than the previous target temperature by the preset temperature to be cold water target temperature.

Also, when the controller 163 determines target temperature of cold water by performing a feedback control on cold water temperature based on a difference between a current open value of the cold water coil 192 and a target open value, the controller 163 may determine the target temperature of the cold water to be within a reference temperature range of cold water.

That is, the electronic device 160 may determine, as shown in FIG. 6, target temperature determined based on a feedback control to be within the reference temperature range of cold water supported by the chiller unit 170. Herein, the reference temperature range may correspond to a temperature range between minimum temperature Min and maximum temperature Max of cold water which may be discharged from the chiller unit 170.

For example, when target temperature within the reference temperature range is calculated based on a feedback control, the electronic device 160 may determine the calculated target temperature to be cold water target temperature. Also, when target temperature that is higher than the reference temperature range is calculated based on a feedback control, the electronic device 160 may determine the maximum temperature Max within the reference temperature range to be cold water target temperature. Also, when target temperature that is lower than the reference temperature range is calculated based on a feedback control, the electronic device 160 may calculate the minimum temperature Min within the reference temperature range to be cold water target temperature.

As such, when the electronic device 160 performs a feedback control on cold water temperature based on an open value of the cold water coil 192, the electronic device 160 may determine, as a settable range, a temperature range within a preset temperature range from previous target temperature within the reference temperature range of cold water, thereby limiting a setting range of cold water target temperature. In this way, by limiting a setting range upon a feedback control for cold water temperature, the electronic device 160 may prevent divergence according to a control error in the feedback control, and prevent sharp changes of room temperature and room humidity, which may be generated by divergence of cold water temperature.

Also, according to some embodiments, when the air conditioning system 1 includes the plurality of air conditioners 190 (190-1, 190-2, . . . , **190-*n*), the electronic device 160 may identify air conditioners operating from among the plurality of air conditioners 190, and determine, as a control target air conditioner, an air conditioner of which an open value of the cold water coil 192 is greatest among the identified air conditioners. Also, the electronic device 160 may perform a feedback control on cold water temperature based on the open value of the cold water coil 192 of the control target air conditioner. That is, the electronic device 160 may determine a target open value of the control target air conditioner according to an air-conditioning load of the control target air conditioner, and control cold water temperature such that the open value of the cold water coil 192** of the control target air conditioner adjust towards the target open value.

Because a great open value of the cold water coil 192 may mean a great air-conditioning load while the same cold water temperature is provided, the electronic device 160 may control cold water temperature based on an air conditioner having a greatest air-conditioning load to provide air conditioning satisfying all of a plurality of indoor spaces corresponding to the plurality of air conditioners 190.

So far, performing a feedback control on temperature of cold water discharged from the chiller unit 170 based on an open value of the cold water coil 192 in the electronic device 160 has been described in detail. Hereinafter, controlling cold water temperature in the electronic device 160 will be described in detail.

Figure 7:
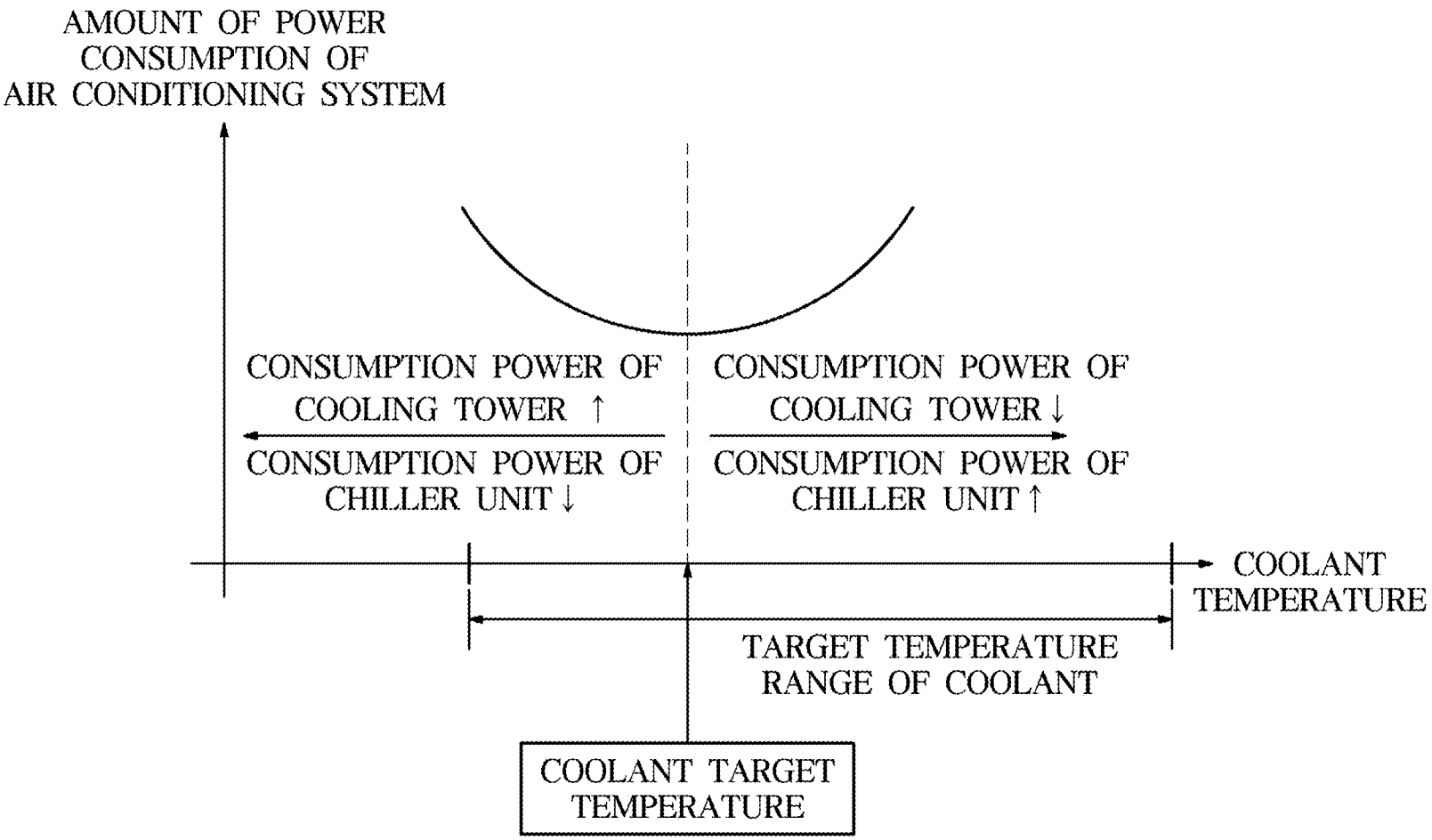
FIG. 7 is a view representing a case of determining coolant temperature in an electronic device according to an embodiment.
Figure 8:
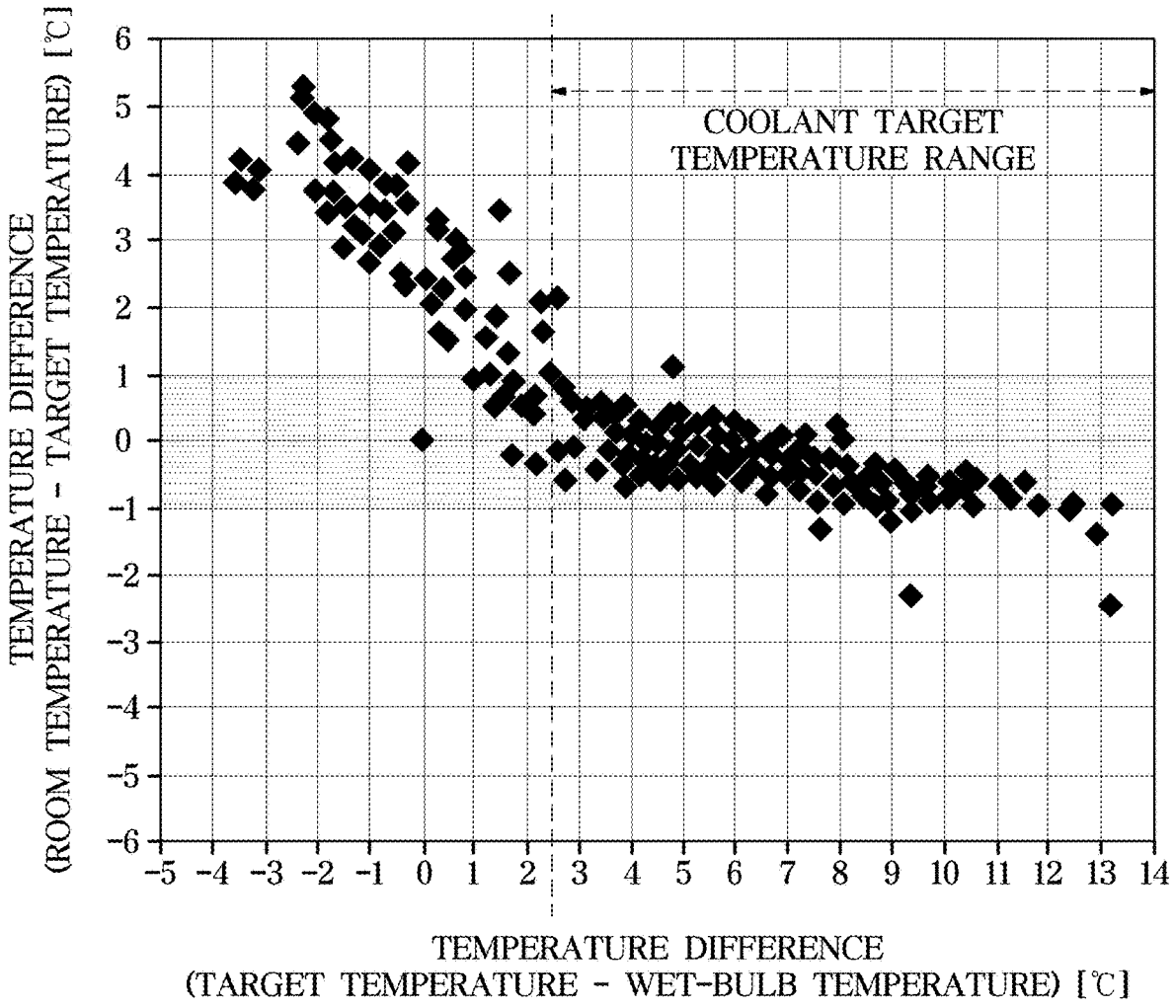
FIG. 8 is a view for describing a case of determining a range of coolant target temperature in an electronic device according to an embodiment.

FIG. 7 is a view representing a case of determining coolant temperature in the electronic device 160 according to an embodiment, and FIG. 8 is a view for describing a case of determining a coolant target temperature range in the electronic device 160 according to an embodiment.

Referring to FIG. 7, to lower temperature of a coolant, consumption power of a cooling fan needs to be raised. Therefore, as temperature of a coolant discharged from the cooling tower 180 is lowered, consumption power of the cooling tower 180 may increase. In other words, as temperature of a coolant increases, consumption power of the cooling tower 180 may be lowered.

However, when temperature of a coolant increases, a coefficient of performance of the condenser of the chiller unit 170 using the coolant may be lowered, so that consumption power of the chiller unit 170 may increase. More specifically, when temperature of a coolant used to condense a refrigerant in the condenser of the chiller unit 170 increases, a coefficient of performance of refrigerant condensation in the chiller unit 170 may be lowered. In this case, to maintain temperature of discharged cold water, the chiller unit 170 may increase power that is supplied to at least one of the compressor, the expander, or the evaporator, thereby compensating the lowered coefficient of performance of refrigerant condensation.

As such, a trade off may occur between the consumption power of the chiller unit 170 and the consumption power of the cooling tower 180 in that, when temperature of a coolant increases so that the consumption power of the cooling tower 180 is lowered, the consumption power of the chiller unit 170 increases to maintain temperature of cold water.

A change in temperature of a coolant may not influence room temperature and room humidity, in that, even when temperature of a coolant discharged from the cooling tower 180 changes, temperature of cold water discharged from the chiller unit 170 can be maintained. However, because a trade off occurs between the consumption power of the chiller unit 170 and the consumption power of the cooling tower 180 according to temperature of a coolant, a coolant target temperature at which an amount of power consumption of the air conditioning system 1, including both consumption power of the chiller unit 170 and consumption power of the cooling tower 180, is minimized may be needed.

Accordingly, the electronic device 160 may determine temperature of a coolant such that an amount of power consumption of the air conditioning system 1 is minimized, based on an output from a neural network that has trained an amount of power consumption according to driving data. The neural network may be trained according to driving data of the air conditioning system 1, and, when the neural network receives coolant temperature information, the neural network may output an amount of power consumption of the air conditioning system 1. Driving data of the air conditioning system 1 may be data about previous driving, and may include at least one of outside temperature, outside humidity, cold water temperature, coolant temperature, and an amount of power consumption upon driving.

At this time, the electronic device 160 may determine, as shown in FIG. 8, a realizable coolant target temperature range based on wet-bulb temperature of outside air to limit an optimization search range. That is, the electronic device 160 may determine temperature that is greater than a difference (e.g., 2.5° C.) between current target temperature and room wet-bulb temperature to be a coolant target temperature range to determine a realizable coolant target temperature range, and determine coolant target temperature at which an amount of power consumption of the air conditioning system 1 is minimized, based on an output from the neural network with respect to the determined coolant target temperature range. In other words, the electronic device 160 may input temperature within a coolant target temperature range to the neural network, and obtain coolant temperature having a minimum amount of power consumption within the coolant target temperature range from the neural network.

Also, according to some embodiments, the electronic device 160 may determine a coolant target temperature range by further considering driving data. More specifically, the electronic device 160 may determine, as a coolant target temperature range, a coolant temperature range of when a difference between room temperature and target temperature is smaller than or equal to a preset range in temperature that is greater than a difference between current target temperature and room wet-bulb temperature, based on driving data.

In other words, as shown in FIG. 8, the electronic device 160 may determine a coolant temperature range of when a difference between room temperature and target temperature is smaller than or equal to a preset range (e.g., 1° C.) in previous driving, based on driving data, and determine, as a coolant target temperature range, a temperature range overlapping with the determined coolant temperature range in temperature that is greater than a difference (e.g., 2.5° C.) between current target temperature and room wet-bulb temperature.

That is, the electronic device 160 may determine, as a coolant target temperature range, a coolant temperature range indicated by driving data in which a difference between room temperature and target temperature is smaller than or equal to a preset range (e.g., 1° C.) in temperature that is greater than a difference (e.g., 2.5° C.) between current target temperature and room wet-bulb temperature.

Thereby, the electronic device 160 may determine, as the coolant target temperature range, coolant temperature capable of supporting target temperature based on driving data, thereby raising the accuracy of a control to target temperature.

As such, the electronic device 160 may determine a coolant target temperature range by considering wet-bulb temperature of outside air or driving data to limit an optimization search range, thereby raising the accuracy of prediction on an amount of power consumption. Also, by limiting learning data to the coolant target temperature range, prediction accuracy may be improved with relatively small learning data.

Figure 9:
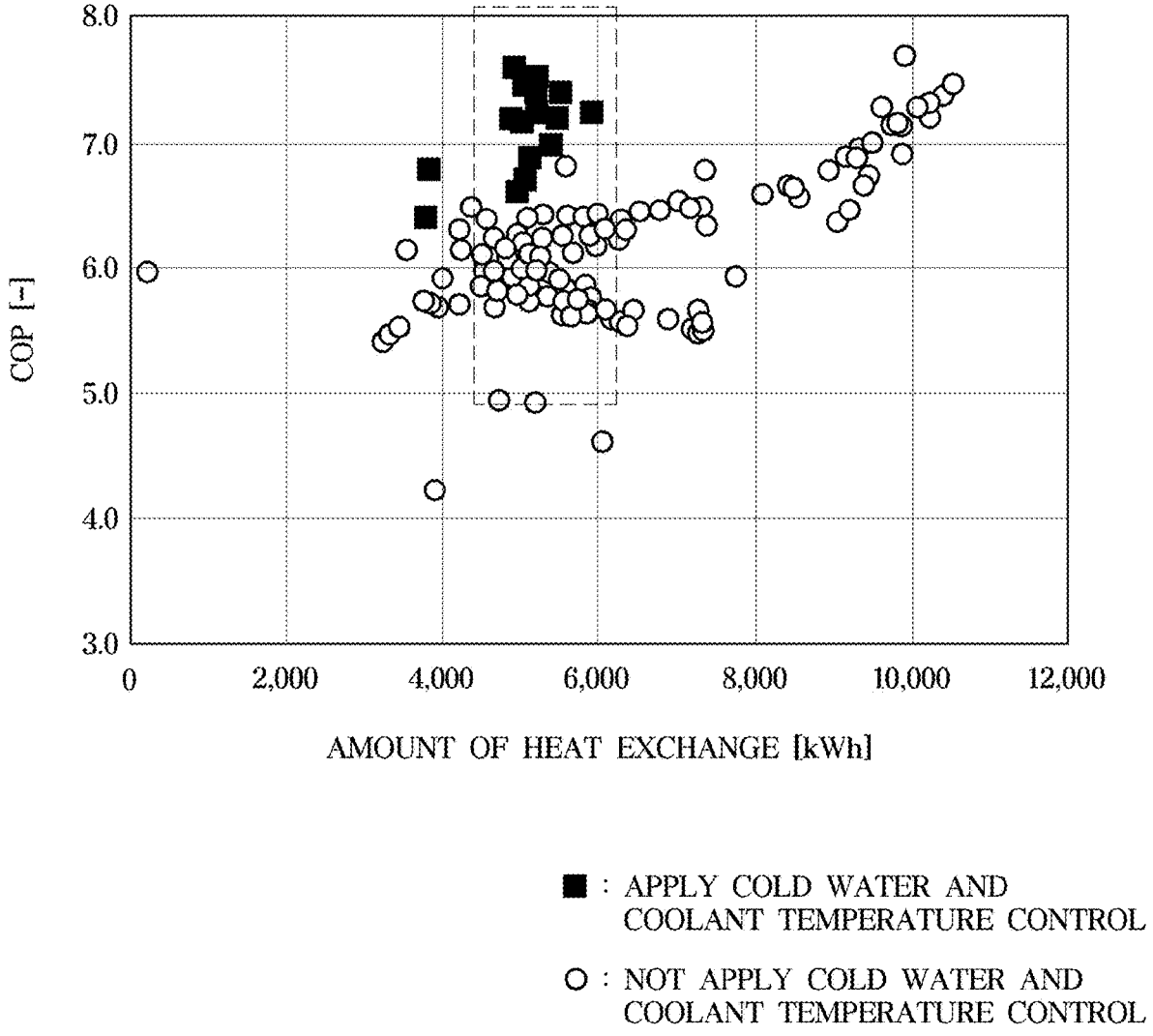
FIG. 9 is a view representing coefficients of performance (COP) in a chiller unit when an air conditioning system according to an embodiment applies a cold water and coolant temperature control.
Figure 10:
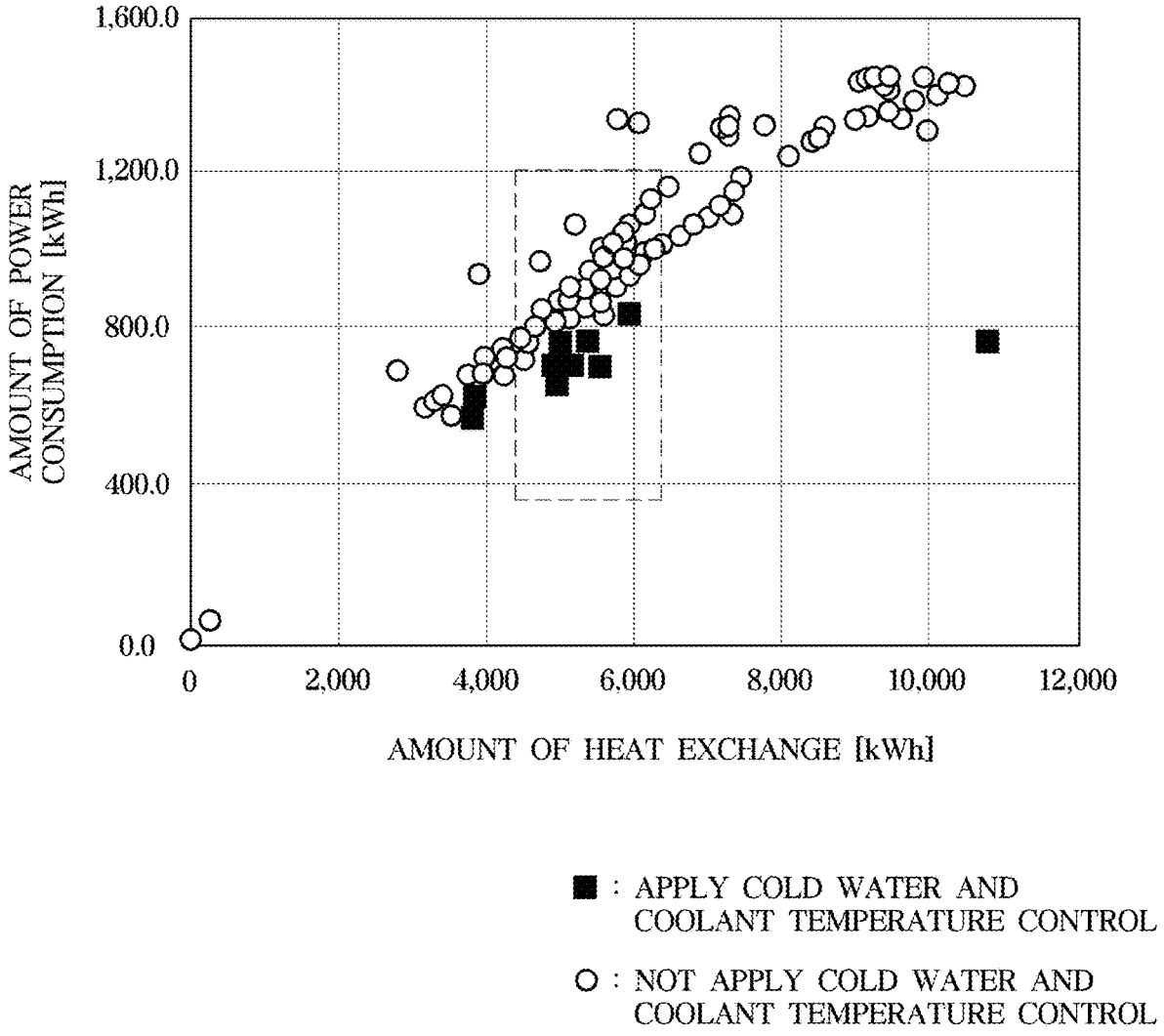
FIG. 10 is a view representing amounts of power consumption when an air conditioning system according to an embodiment applies a cold water and coolant temperature control.

FIG. 9 is a view representing coefficients of performance in the chiller unit 170 when the air conditioning system 1 according to an embodiment applies a cold water and coolant temperature control, and FIG. 10 is a view representing amounts of power consumption when the air conditioning system 1 according to an embodiment applies a cold water and coolant temperature control.

Referring to FIG. 9, when the air conditioning system 1 according to an embodiment applies a cold water temperature control and a coolant temperature control, a coefficient of performance (COP) of the chiller unit 170 may increase.

More specifically, the electronic device 160 may set cold water temperature to high temperature within a range in which the cold water temperature does not influence room temperature and room humidity, thereby lowering consumption power of the chiller unit 170. More specifically, the electronic device 160 may determine a target open value of the cold water valve 199 based on a change amount of an air-conditioning load of the air conditioner 190, and control target temperature of cold water such that an open value of the cold water valve 199 adjust towards the determined target open value. Thereby, the electronic device 160 may reduce consumption power of the chiller unit 170 while adaptively controlling cold water temperature to correspond to the change of the air-conditioning load, thereby reducing an amount of power consumption of the air conditioning system 1 while maintaining cooling capacity.

As a result, the electronic device 160 may provide the same amount of heat exchange while lowering consumption power, by adaptively controlling cold water temperature, thereby raising a coefficient of performance of the chiller unit 170.

Also, the electronic device 160 may lower consumption power of the chiller unit 170 by adjusting cold water target temperature, and determine coolant target temperature at which an amount of power consumption of the air conditioning system 1 is minimized, based on an output from a neural network that has trained an amount of power consumption according to driving data. Thereby, the air conditioning system 1 may lower an amount of power consumption while providing the same amount of heat exchange, as shown in FIG. 10.

Hereinafter, an embodiment for a method of controlling the electronic device 160, according to an aspect, will be described. In the method of controlling the electronic device 160, the electronic device 160 according to the above-described embodiment may be used. Accordingly, content described above with reference to FIGS. 1 to 10 may be applied in the same manner to the method of controlling the electronic device 160.

Figure 11:
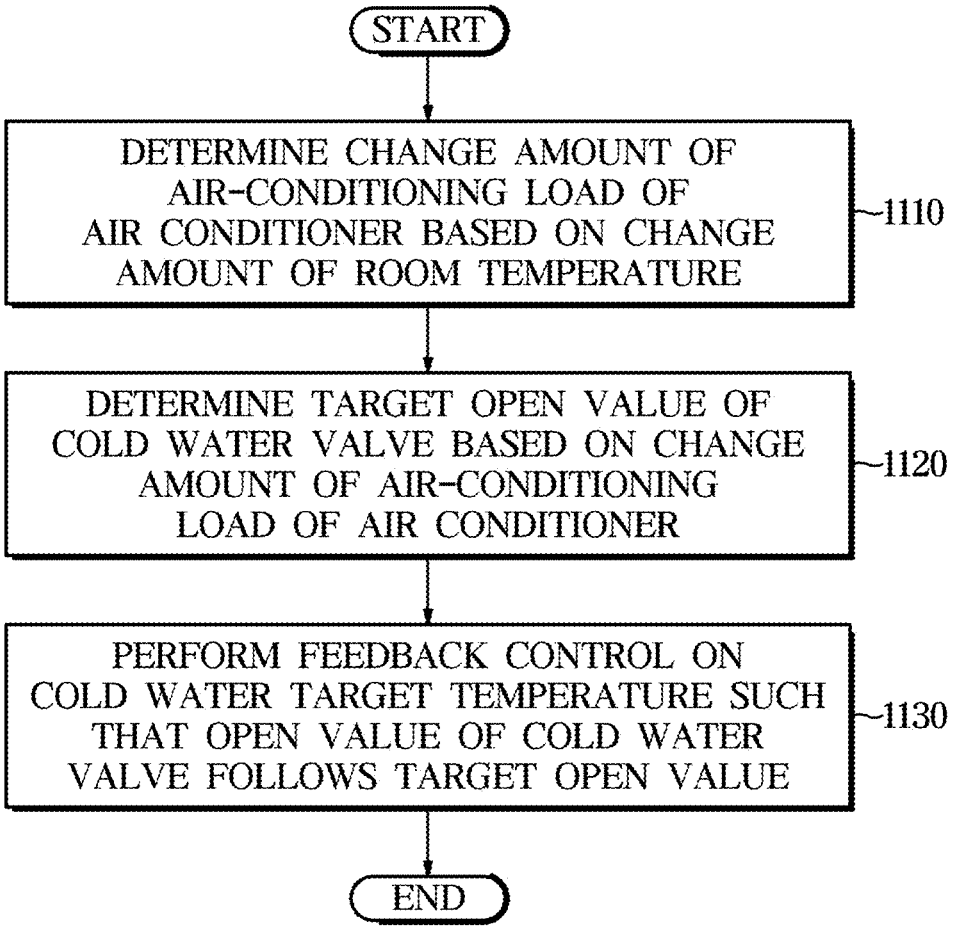
FIG. 11 is a flowchart showing a case of determining cold water target temperature in a method of controlling an electronic device according to an embodiment.

FIG. 11 is a flowchart showing a case of determining cold water target temperature in a method of controlling the electronic device 160 according to an embodiment.

Referring to FIG. 11, the electronic device 160 according to an embodiment may determine a change amount of an air-conditioning load of the air conditioner 190 based on a change amount of room temperature (1110), and determine a target open value of the cold water valve 199 based on the change amount of the air-conditioning load of the air conditioner 190 (1120).

The electronic device 160 may determine the amount of change of the air-conditioning load of the air conditioner 190 based on a temperature change amount of room temperature per unit time. The air-conditioning load of the air conditioner 190 may change more greatly as a change of room temperature per unit time with respect to target temperature is greater. Accordingly, when room temperature changes greatly due to a use environment of an indoor space, a condition of outside air, air-conditioning equipment replacement, a change of a control method of equipment installed in an indoor space, etc., an air-conditioning load of the air conditioner 190 may also change greatly.

The electronic device 160 may reduce a target open value of the cold water valve 199 when a change amount of an air-conditioning load increases, and, when a change amount of an air-conditioning load reduces, the electronic device 160 may increase a target open value of the cold water valve 199.

The electronic device 160 according to an embodiment may perform a feedback control on cold water target temperature such that an open value of the cold water valve 199 adjust towards the target open value (1130).

For this, the electronic device 160 may perform a feedback control on cold water temperature such that a difference between an open value of the cold water valve 199 and the determined target open value is reduced, thereby controlling an open value of the cold water valve 199 to follow the target open value. That is, the electronic device 160 may perform a feedback control (e.g., PI control or PID control) on cold water temperature based on a difference between an actual open value and the target open value.

At this time, when a change amount of an air-conditioning load is small, the electronic device 160 may increase a target open value of the cold water valve 199 to raise temperature of cold water, and perform a feedback control on cold water temperature based on a difference between an open value of the cold water valve 199 and the target open value. Thereby, the electronic device 160 may lower consumption power of the chiller unit 170. That is, when an air-conditioning load of the air conditioner 190 is constant, the electronic device 160 may increase a target open value of the cold water valve 199 and reduce cold water temperature, to lower consumption power of the chiller unit 170 while providing a constant amount of heat exchange with respect to the air-conditioning load.

Also, when a change amount of an air-conditioning load is great, the electronic device 160 may reduce a target open value of the cold water valve 199, and perform a feedback control on cold water temperature based on a difference between an open value of the cold water valve 199 and the target open value.

That is, the electronic device 160 may ensure a wide control range of cold water temperature by reducing an open value of the cold water valve 199. As an open value of the cold water valve 199 is reduced, cold water temperature required to provide the same amount of heat exchange may be lowered, and an increasable range of cold water temperature may be widened by the lowered cold water temperature to widen a control range of cold water temperature.

Accordingly, when a change amount of an air-conditioning load is great, the electronic device 160 may adjust a target open value to reduce an open value of the cold water valve 199 and ensure a wide control range of cold water temperature, thereby adaptively controlling cold water temperature to correspond to the change of the air-conditioning load. For example, when an air-conditioning load is reduced greatly, the electronic device 160 may raise cold water temperature to higher temperature to correspond to the wide control range, thereby greatly reducing consumption power.

Thereby, the electronic device 160 may lower consumption power of the chiller unit 170 while adaptively controlling cold water temperature to correspond to the change of the air-conditioning load, thereby reducing an amount of power consumption of the air conditioning system 1 while maintaining cooling capacity.

At this time, when the electronic device 160 performs a feedback control on cold water temperature based on the open value of the cold water coil 192, the electronic device 160 may determine, as a settable range, a temperature range within a preset temperature range from previous target temperature within a reference temperature range of cold water, thereby limiting a setting range of cold water target temperature. Thereby, by limiting a setting range upon a feedback control for cold water temperature, the electronic device 160 may prevent divergence according to a control error in the feedback control, and prevent sharp changes of room temperature and room humidity, which may be generated by divergence of cold water temperature.

Figure 12:
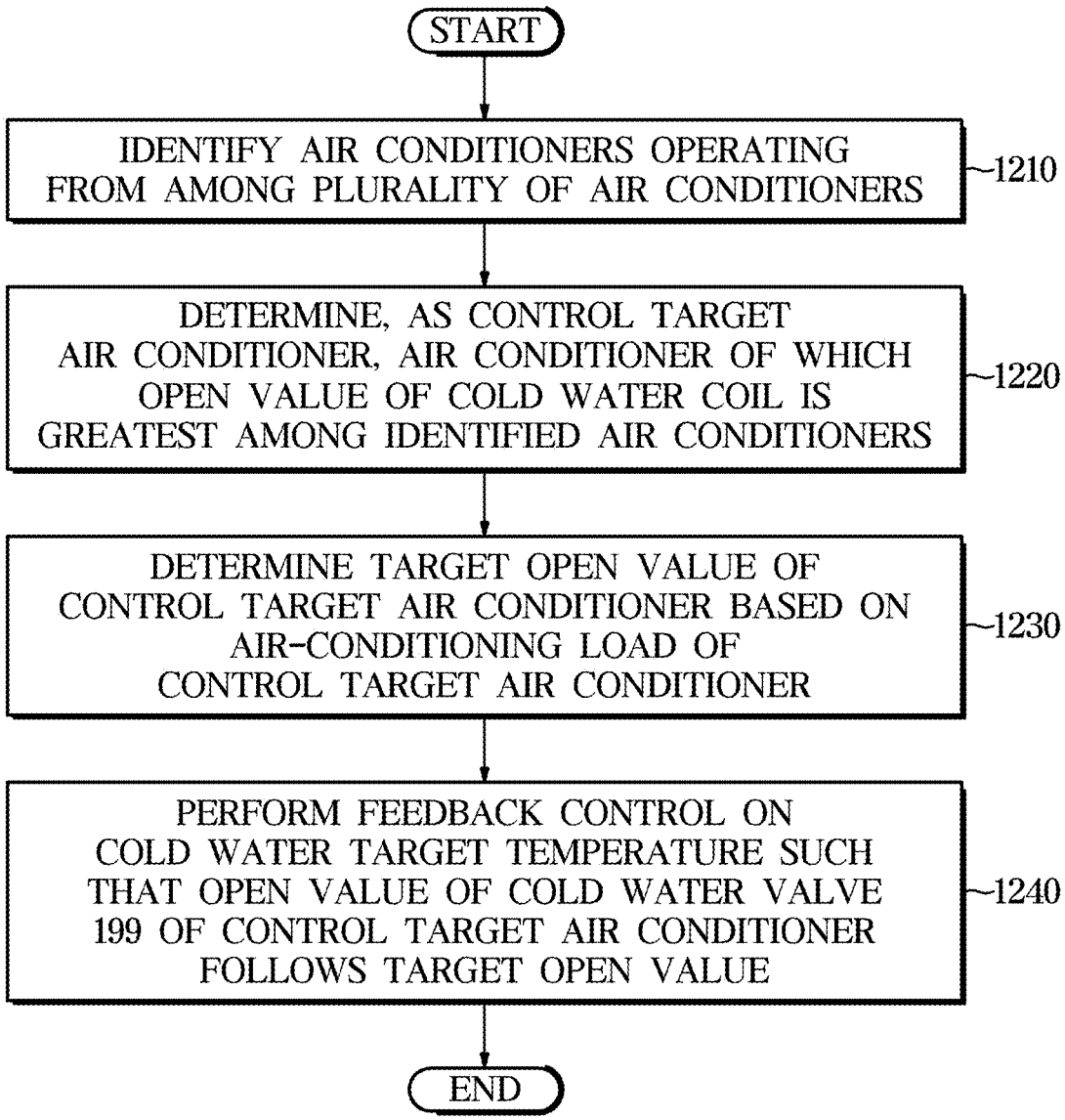
FIG. 12 is a flowchart showing a case of determining cold water target temperature when a plurality of air conditioners are used in a method of controlling an electronic device according to an embodiment.

FIG. 12 is a flowchart showing a case of determining cold water target temperature when the plurality of air conditioners 190 are used in a method of controlling the electronic device 160 according to an embodiment.

Referring to FIG. 12, the electronic device 160 according to an embodiment may identify air conditioners operating from among the plurality of air conditioners 190 (190-1, 190-2, . . . , **190-*n*) (1210), and determine, as a control target air conditioner, an air conditioner of which an open value of the cold water coil 192 is greatest among the identified air conditioners (1220**).

Also, the electronic device 160 according to an embodiment may determine a target open value of the control target air conditioner based on an air-conditioning load of the control target air conditioner (1230), and perform a feedback control on cold water target temperature such that the open value of the cold water valve 199 of the control target air conditioner adjust towards the target open value (1240).

Because a great open value of the cold water coil 192 may mean a great air-conditioning load while the same cold water temperature is provided, the electronic device 160 may control cold water temperature based on an air conditioner having a greatest air-conditioning load to provide air conditioning satisfying all of a plurality of indoor spaces corresponding to the plurality of air conditioners 190.

Figure 13:
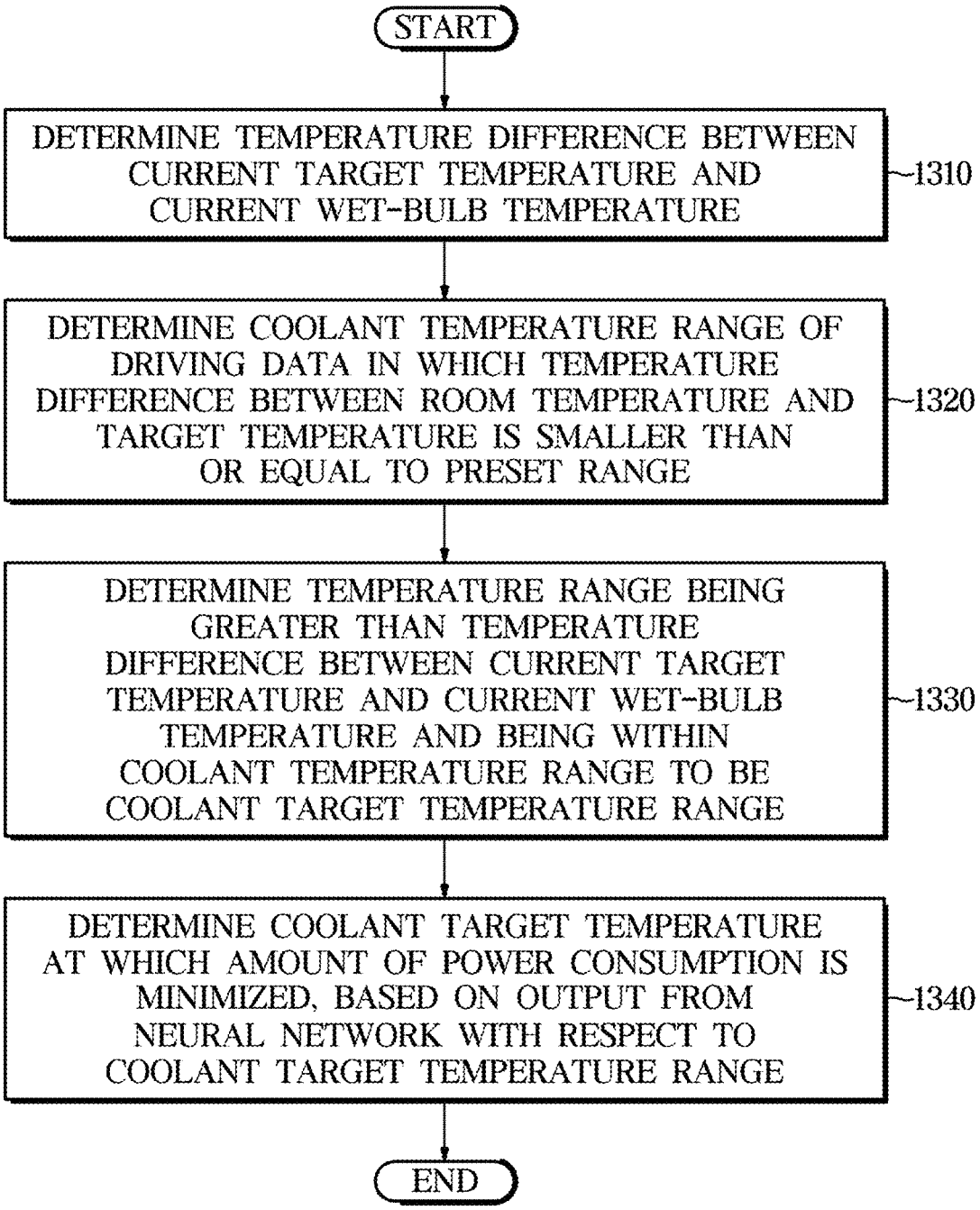
FIG. 13 is a flowchart showing a case of determining coolant target temperature in a method of controlling an electronic device according to an embodiment.

FIG. 13 is a flowchart showing a case of determining coolant target temperature in a method of controlling the electronic device 160 according to an embodiment.

Referring to FIG. 13, the electronic device 160 according to an embodiment may determine a temperature difference between current target temperature and room wet-bulb temperature (1310), and determine a coolant temperature range of driving data in which a temperature difference between room temperature and target temperature is smaller than or equal to a preset range (1320).

Also, the electronic device 160 according to an embodiment may determine a temperature range being greater than a temperature difference between current target temperature and room wet-bulb temperature and being within a coolant temperature range to be a coolant target temperature range (1330). Thereafter, the electronic device 160 may determine coolant target temperature at which an amount of power consumption is minimized, based on an output from a neural network with respect to the coolant target temperature range (1340).

Also, the electronic device 160 may determine temperature of a coolant based on an output from the neural network that has trained an amount of power consumption according to driving data such that an amount of power consumption of the air conditioning system 1 is minimized. The neural network may be trained according to driving data of the air conditioning system 1, and, when the neural network receives coolant temperature information, the neural network may output an amount of power consumption of the air conditioning system 1. Driving data of the air conditioning system 1 may be data about previous driving, and may include at least one of outside temperature, outside humidity, cold water temperature, coolant temperature, and an amount of power consumption upon driving.

At this time, the electronic device 160 may determine, as shown in FIG. 8, a realizable coolant target temperature range based on wet-bulb temperature of outside air to limit an optimization search range. That is, the electronic device 160 may determine temperature that is greater than a difference (e.g., 2.5° C.) between current target temperature and room wet-bulb temperature to be a coolant target temperature range to determine a realizable coolant target temperature range, and determine coolant target temperature at which an amount of power consumption of the air conditioning system 1 is minimized, based on an output from the neural network with respect to the determined coolant target temperature range. In other words, the electronic device 160 may input temperature within the coolant target temperature range to the neural network, and obtain coolant temperature having a minimum amount of power consumption within the coolant target temperature range from the neural network.

Also, according to some embodiments, the electronic device 160 may determine a coolant target temperature range by further considering driving data. More specifically, the electronic device 160 may determine, as a coolant target temperature range, a coolant temperature range of when a difference between room temperature and target temperature is smaller than or equal to a preset range in temperature that is greater than a difference between current target temperature and room wet-bulb temperature, based on driving data.

That is, the electronic device 160 may determine, as a coolant target temperature range, a coolant temperature range indicated by driving data in which a difference between room temperature and target temperature is smaller than or equal to a preset range in temperature that is greater than a difference between current target temperature and room wet-bulb temperature.

Thereby, the electronic device 160 may determine, as the coolant target temperature range, coolant temperature capable of supporting target temperature based on driving data, thereby raising the accuracy of a control to target temperature.

As such, the electronic device 160 may determine a coolant target temperature range by considering wet-bulb temperature of outside air or driving data to limit an optimization search range, thereby raising the accuracy of prediction on an amount of power consumption. Also, by limiting learning data to the coolant target temperature range, prediction accuracy may be improved with relatively small learning data.

Also, the disclosed embodiments may be implemented in the form of a recording medium that stores commands executable by a computer. The commands may be stored in the form of a program code, and when executed by a processor, the commands may create a program module to perform operations of the disclosed embodiments. The recording medium may be implemented as a computer-readable recording medium.

The computer-readable recording medium may include all kinds of recording media storing commands that can be interpreted by a computer. For example, the recording media may include Read Only Memory (ROM), Random Access Memory (RAM), a magnetic tape, a magnetic disc, flash memory, an optical data storage device, etc.

Although the present disclosure has been described with various embodiments, various changes and modifications may be suggested to one skilled in the art. It is intended that the present disclosure encompass such changes and modifications as fall within the scope of the appended claims.

What is claimed is:

1. An electronic device comprising:

a communicator configured to communicate with an air conditioner including a coil through which cold water flows and a valve for adjusting an amount of the cold water, a chiller unit, and a cooling tower; and a controller configured to:

determine a target open value of the valve based on a change amount of an air-conditioning load of the air conditioner, control a temperature of the cold water supplied from the chiller unit to the air conditioner such that an open value of the valve adjusts towards the target open value, and control a temperature of a coolant to minimize an amount of power consumption that is determined based on an output from a neural network that has been trained for an amount of power consumption according to an outside wet-bulb temperature, a room wet-bulb temperature, the temperature of the coolant supplied from the cooling tower to the chiller unit, and the temperature of the cold water.

2. The electronic device of claim 1, wherein:

the air conditioner is configured to:

increase the open value of the valve based on a room temperature exceeding a target temperature, and reduce the open value of the valve based on the target temperature exceeding the room temperature, and the controller is further configured to:

reduce the target open value based on the change amount of the air-conditioning load increasing, and increase the target open value based on the change amount of the air-conditioning load decreasing.

3. The electronic device of claim 2, wherein the controller is further configured to control the temperature of the cold water to reduce a difference between the open value of the valve and the target open value.

4. The electronic device of claim 3, wherein the controller is further configured to perform a feedback control on the temperature of the cold water to determine a target temperature of the cold water to maintain the target temperature of the cold water within a preset temperature range from a previous target temperature of the cold water.

5. The electronic device of claim 4, wherein the controller is further configured to determine the target temperature of the cold water to be within a reference temperature range of the cold water.

6. The electronic device of claim 1, wherein the controller is further configured to:

determine an air conditioner of which an open value of a respective valve is greatest from among a plurality of air conditioners, and control the temperature of the cold water such that the open value of the respective valve of the determined air conditioner adjust towards the target open value.

7. The electronic device of claim 1, wherein the controller is further configured to:

determine a target temperature range of the coolant based on the outside wet-bulb temperature, and determine the temperature of the coolant based on the output from the neural network with respect to the determined target temperature range.

8. The electronic device of claim 7, wherein the controller is further configured to determine a temperature range that is greater than a difference between a current target temperature and a current wet-bulb temperature to be the target temperature range of the coolant.

9. The electronic device of claim 8, wherein the controller is further configured to:

determine driving data in which a difference between a room temperature and a target temperature is smaller than or equal to a preset range, and determine a coolant temperature range of the determined driving data to be the target temperature range of the coolant.

10. A method of controlling an electronic device, the electronic device including a communicator communicating with an air conditioner including a coil through which cold water flows and a valve for adjusting an amount of the cold water, a chiller unit, and a cooling tower, the method comprising:

determining a target open value of the valve based on a change amount of an air-conditioning load of the air conditioner;

controlling a temperature of the cold water supplied from the chiller unit to the air conditioner such that an open value of the valve adjust towards the target open value; and controlling a temperature of a coolant to minimize an amount of power consumption that is determined based on an output from a neural network that has been trained for an amount of power consumption according to an outside wet-bulb temperature, a room wet-bulb temperature, the temperature of the coolant supplied from the cooling tower to the chiller unit, and the temperature of the cold water.

11. The method of claim 10, wherein:

the air conditioner is configured to increase the open value of the valve based on a room temperature exceeding a target temperature and reduce the open value of the valve based on the target temperature exceeding the room temperature, and the determining of the target open value of the valve based on the change amount of the air-conditioning load of the air conditioner comprises:

reducing the target open value based on the change amount of the air-conditioning load increasing; and increasing the target open value based on the change amount of the air-conditioning load decreasing.

12. The method of claim 11, wherein the controlling of the temperature of the cold water such that the open value of the valve adjust towards the target open value comprises:

controlling the temperature of the cold water to reduce a difference between the open value of the valve and the target open value.

13. The method of claim 12, wherein the controlling of the temperature of the cold water such that the open value of the valve adjust towards the target open value comprises:

performing a feedback control on the temperature of the cold water to determine a target temperature of the cold water to maintain the target temperature of the cold water to be within a preset temperature range from a previous target temperature of the cold water.

14. The method of claim 13, wherein the controlling of the temperature of the cold water such that the open value of the valve adjust towards the target open value comprises:

determining the target temperature of the cold water to be within a reference temperature range of the cold water.

* * * * *